United States Patent [19]

Konzal et al.

[11] Patent Number: 4,819,411

[45] Date of Patent: Apr. 11, 1989

[54] HIGH CAPACITY CONTINUOUS PACKAGE SEAM AND TAB FOLDING AND TACKING APPARATUS AND METHOD

[75] Inventors: Daryl Konzal, Colgate; Gunars Salnajs, Milwaukee, both of Wis.

[73] Assignee: International Paper Company, Purchase, N.Y.

[21] Appl. No.: 212,687

[22] Filed: Jun. 28, 1988

Related U.S. Application Data

[62] Division of Ser. No. 942,850, Dec. 17, 1986, Pat. No. 4,776,147.

[51] Int. Cl.[4] ..... B65B 61/24; B65B 1/24; B65B 7/20

[52] U.S. Cl. ..... 53/439; 53/113; 53/526; 53/527; 53/479

[58] Field of Search ..... 53/436, 439, 463, 479, 53/482, 491, 113, 526, 527, 375, 378, 379, 388; 156/196, 227, 228, 274.6, 275.1, 290, 308.4, 309.6, 446, 456

[56] References Cited

U.S. PATENT DOCUMENTS

| | | | |
|---|---|---|---|
| 3,303,630 | 2/1967 | Harm | 53/450 |
| 3,831,343 | 8/1974 | Dominici . | |
| 3,857,223 | 12/1974 | Dominici . | |
| 3,973,474 | 8/1976 | Auckenthaler . | |
| 4,034,537 | 7/1977 | Reil et al. . | |
| 4,046,308 | 9/1977 | Silver . | |
| 4,077,186 | 3/1978 | Voegele . | |
| 4,080,237 | 3/1978 | Deimel . | |
| 4,085,568 | 4/1978 | Focke et al. . | |
| 4,102,486 | 7/1978 | Focke et al. . | |
| 4,174,988 | 11/1979 | Moore et al. | 156/492 |
| 4,199,919 | 4/1980 | Moscatelli . | |
| 4,346,545 | 8/1982 | Crescenzo . | |
| 4,349,345 | 9/1982 | Bodendoerfer . | |
| 4,384,438 | 5/1983 | Hilmersson . | |
| 4,387,547 | 6/1983 | Reil . | |
| 4,429,513 | 2/1984 | Beckers et al. . | |
| 4,430,141 | 2/1984 | Zodrow | 156/458 |
| 4,444,613 | 4/1984 | Burmeister | 156/458 |
| 4,462,202 | 7/1984 | Reil . | |
| 4,495,745 | 1/1985 | Crescenzo et al. . | |
| 4,510,732 | 4/1985 | Löthman . | |
| 4,528,803 | 7/1985 | Ott . | |
| 4,633,649 | 1/1987 | Gautier et al. | 53/450 |
| 4,776,147 | 10/1988 | Konzal et al. | 53/379 X |

*Primary Examiner*—Horace M. Culver
*Attorney, Agent, or Firm*—Robert M. Isackson

[57] ABSTRACT

Improved method and apparatus for continuously folding, heating, and tacking to the sides of the package panel the excess packaging material created by forming the package from a web of polyfoil material. The method and apparatus is particularly useful in form, fill, and seal machines that form a plurality of aseptic sealed packages from a continuously advancing tube filled with a product, and incorporate a plurality of package receiving means mounted on a continuously advancing structure that forms sealed product filled packages into rectangular finished bricks by squaring the package, heating the excess material, folding the excess material against the package until it cools to thereby tack it.

4 Claims, 20 Drawing Sheets

UPPER SCORE PLATE
WEB
LOWER SCORE PLATE 41
39
39a
40a
42a
43
44
45
46a
46b
62
63
66
66a
67
68
24
26
N
P
A 10
10
11
11
11

271b
281
278
276
277
278
271a
275
281
30
274
273
272

34d
278
30
34a
481a
278
34b
481b
478b
480b
489
488
478a
480a
489
34d
34a
488
490d
34a
490c
490b
488
490a
490d
491
496
490b
491
490c
491
490a
320a
320b
493b
321b
319b
493a
321a
322b
319a
322a
489
488
31

HIGH CAPACITY CONTINUOUS PACKAGE SEAM AND TAB FOLDING AND TACKING APPARATUS AND METHOD

This is a division, of application Ser. No. 942,850, filed Dec. 17, 1986 in the names of Darryl Konzal and Gunars Salnajs entitled Improved High Capacity continuous package seam and tab folding and tacking apparatus and method which issued as U.S. Pat. No. 4,776,147.

This invention relates to a method and machine for continuously forming sealed packages at high rates of production, particularly to an improved method and apparatus for folding and tacking the excess packaging material created during formation of sealed packages, e.g., tabs, seams, and the like, flat against the walls of sealed and product-filled packages.

BACKGROUND OF THE INVENTION

Several methods and machines for forming aseptic and non aseptic packages or cartons from paper stock and laminated web packaging materials are known. These methods and machines generally fall into two categories. In the first category, packages are made on blank fed machines wherein the supply of web is first separately formed into cut and scored blanks. The blanks are then fed into the forming section of the machine one at a time and erected into containers, filled, and sealed. For aseptic packaging, the containers are sterilized, filled with a sterile product while in a sterile environment, and sealed hermetically closed. In the process of forming finished sealed containers, the excess packaging material may be tacked, i.e., flattened against adjacent package panels and secured thereto, to provide a substantially smooth package surface that is convenient for handling, bundling, and storage.

The blank fed machines typically operate intermittently, performing one assembly step at a station and then advancing the blank or carton to the next station for the next operation. Other blank fed machines may operate semi-continuously, for example, continuously advancing the blank to form the container and then intermittently advancing the container to sterilize, fill, and seal the container and fold and tack flat against the container walls the excess packaging material created by sealing and bricking of the package as the package moves along its path of travel. One commercial intermittent type blank fed aseptic machine is Combiblok Model No. CF 606A, Columbus, Ohio.

The second category of package forming machines are those that use web from a continuous roll and advance the web to form, fill, seal, and sever the packages. In these machines, the web is taken directly off the roll of web stock, scored (unless prescored on the roll) and fed into the machine. The machine then folds the web to form a column, seals the longitudinal edge to form a tube, fills the tube with a product, and clamps, seals, and severs the tube to form the packages. The packages are then operated upon to form them into the desired final configuration, e.g., a rectangular brick, by folding and tacking the excess packaging material in the package corners and seams securely against the package panels. The web advance may be continuous to gradually manipulate the web into sealed packages, or intermittent so that each assembly operation is performed at a different station while the web is stationary, or while the web is moving between stations.

For aseptic packaging, the web is sterilized, fed into a sterile machine zone, and appropriately, filled With the product in a sterile environment, and sealed to maintain sterility. One commercial automatic continuous feed aseptic machine is Tetra-Pak Model AB 9. Other known aseptic machines include International Paper Co.'s web fed aseptic package machine, Model SA.

Reciprocating means may be used to operate on the web or packages, either first, reciprocating into position and operation when the web or package is stationary and reciprocating out of position and operation when the web or package is advanced, or second, reciprocating with and operating on the web or package as it advances and then, at the end of its stroke range, reciprocating back to the beginning of its stroke while the web or package is stationary. Reciprocating means must return to a point of origin at the beginning of its stroke range before working on the next section of web. There may be one or more reciprocating means which reciprocate while the web or severed packages continue to advance. Alternately, opposing endlessly rotating means may be used such as wheels or endless linked belts containing a plurality of identical means for sequentially operating on the Web or packages as the web or packages advance at a substantially uniform speed. The present invention relates to an improvement in continuous feed type machines, and is designed to have a production rate substantially higher than that of presently known machines, for example, greater than 10,000 quarter liter packages per hour.

The primary problem with the aforementioned machines is that they are limited in the machine speed and material control required to continuously or intermittently make aseptic packages at a rate of speed higher than presently obtainable in an economically efficient manner. One specific problem with the known machines is the time required to provide a package that can be easily bundled or stored and is esthetically acceptable to the consumer. Finishing the package typically requires folding the tabs and, optionally, seams, created during the forming, filling, and severing steps to make a commercially acceptable square or rectangular final carton at the desired high rates of production. The aforementioned machines may require indexing one or more carousels which operate on the package while it is stationary as the package is advanced through a series of work stations. Indexing carousels are limited in speed because of the time limits imposed in operating on and advancing the packages incrementally for each successive operation.

Merely increasing the frequency of reciprocation or indexed advance to increase the rate of production would increase wear and may not provide sufficient time to satisfactorily tack the seams and tabs. Further, rapid start and stops could cause such an apparatus to shake itself apart. Adding a second reciprocating device to increase the volume of production could be used. However, this technique does not increase the reciprocation or production rates and adds undue mechanical complexity to distribute the sealed packages to the carousels alternately or to permit plural means to operate simultaneously, out of phase. Adding further tab folding apparatus to accommodate finishing more packages per hour from a single form, fill and seal machine becomes even more complex and difficult.

Moreover, adding a second or multiple production lines does not solve the problem of increasing the production rate of a single machine. Multiple production lines mounted on a common frame may achieve some efficiencies in reducing the number of product supply means, drive means, and the like, but it is effectively the same as two or multiple machines and can require multiple package handling equipment devices such as straw applicators, six pack package bundling equipment, and may require dedicated sterile air sources, one such device for each line. The rate of production is not increased, only the volume. Such machines, e.g., the aforementioned Combiblok machine which has two parallel production lines, and other known models which have four production lines, are unduly bulky, complicated mechanically, and occupy a substantial amount of floor space. Further, the more common elements shared by the multiple lines, the more complicated and expensive the machine becomes, especially if the entire machine must be stopped to fix a problem present in only one of the lines.

It is therefore an object of this invention to provide a method and apparatus for folding and tacking the excess packaging material and bricking each package into its final form as the package advances continuously at high rates of speed.

SUMMARY OF THE INVENTION

This invention provides an improved method and apparatus for forming finished packages wherein the excess packaging material is neatly folded and tacked against the package walls at very high rates of speed. In particular, the method and machine are adapted for use in making aseptic packages formed from a continuous web of laminated material during continuously advancing operation, preferably under microprocessor control.

Finished aseptic packages, also referred to herein as containers or bricks, refer to uniformly sized, sealed containers containing a predetermined amount of a product made in accordance with commercial aseptic packaging standards. Commercial aseptic packaging involves introducing a sterile product into a sterile container and then hermetically sealing the container in an environment substantially free of microorganisms capable of growing in a shelf stable product at temperatures at which the finished product is likely to be stored during distribution and storage prior to consumption. Preferably, the package is also substantially free of air which, if present in significant amounts, could promote undesired microbial growth or, even in the absence of microbial growth, adversely affect the taste or color of a product. The product is typically a fluid drink such as milk, fruit juices, and the like. To obtain the sterile environment substantially free of microorganisms, all of the equipment surfaces that could introduce microbial contamination must be sterilized before the start of filling operations and maintained sterile.

The laminated material preferably comprises at least one layer of current carrying material such as aluminum foil, an inner layer of thermoplastic material to be in contact with the product, and an outer layer of material preferably thermoplastic for contact with the environment. The laminated material, referred herein to as "polyfoil web", is preferably strong enough to stand upright in a somewhat rigid configuration to contain the product for shipping and storage, and preferably includes a conventional paperboard layer that may be preprinted with product labeling. In some polyfoil webs, the printing may occur on the outer thermoplastic layer of the laminated web.

The thermoplastic material must be capable of being heated to a melting temperature so that it will fuse to an opposing similarly heated thermoplastic material to form hermetic seals. The hermetic barrier substantially prevents the transmission of gases, fluids, or biologicals therethrough. In the preferred embodiment, the thermoplastic layer and the metallic foil layer act in concert to provide the hermetic barrier for the aseptic package. In particular, the foil layer provides a light and oxygen barrier. The outer layer is preferably a flexible substantially clear thermoplastic material. The assembled laminate may be a commercial material and may comprise spaced access means to enable the user to extract the product from the finished package.

The present invention provides a plurality of means for squaring or bricking of the sealed package and heating the excess packaging material formed of the web during creation of the package, specifically, tabs at the packaged corners, and optionally, side seams on the package panels, and the corresponding and adjacent package panels. Heating is for a period of time sufficient to first, soften substantially the outer thermoplastic layer of the tab or seam and the corresponding package panels, and second, fold the heated tabs and seams against the heated package panels, holding them there while the package advances until the thermoplastic cools sufficiently so that the tabs and seams will be tacked to the package panel, thereby forming a finished aseptic package or brick.

In the preferred embodiment, the tube of material is longitudinally sealed, preferably by inducing a radio frequency current in the conductive layer of the web sufficient to generate heat resistively and conductively, to heat, soften, and melt the opposing inner thermoplastic layers, so that the heated longitudinal edges of the Web join together to form a homogeneous hermetic longitudinal seal, preferably one segment at a time so that the segments overlap to form a continuous seal. Transverse seals are preferably formed in a similar manner, although the power density and duration may be different than that required for forming a longitudinal seal segment. After formation, the longitudinal seal may be pressed against the package to initiate a bend and to provide the longitudinal seam with a predisposed fold When the tabs are folded against the package bottom over the longitudinal seam, thereby facilitating uniform squaring of the package panel having the longitudinal seal.

Preferably, the severed packages are preformed, i.e., pressed against a plurality of flanges into about their final configuration to fold the web along its score lines, or if no scorelines exist, to initiate folds in the web. In one embodiment, the package is oriented so that the panel that will be the top of the package is the leading edge as the package traverses a conveyor belt. The side seams and corresponding package panels are heated, prefer ably with hot air, and gradually folded and held against the package panel so that the outer thermoplastic layers of the polyfoil stick an adhere together as they cool, thereby tacking the side seams. The package is then inserted leading edge first into a package forming wheel. The tabs at the package corners are then heated, folded against the corresponding package panels, and held until the thermoplastic cools to tack the tabs. In this embodiment, the side seams are tacked first so that the triangular tabs formed by seam tacking are well defined and extend parallel to the seams substantially in an "H" like configuration.

In the most preferred embodiment, the package is provided with a rectangular cross section and guide means are used to fold the seams along the package sides over against their corresponding and adjacent package panels. The seams are folded, but neither heated nor tacked. The corner triangular tabs are folded, heated and tacked over the seams and provide the package with its finished bricked configuration.

The apparatus of the present invention comprises folding and tacking apparatus, preferably including a source of hot air for heating the outer thermoplastic layer of the excess packaging material and adjacent package panels and guide means to fold the heated material against the heated package panels to be cooled and tacked in place. Other means of heating the thermoplastic surface may be used such as radiant heat, induction heat, and the like.

It is to be understood that while the present invention is discussed in the context of producing quarter-liter aseptic packages, one skilled in the art could use the method and apparatus in other areas including, but not limited to, packages and tabs of different sizes and shapes, non-aseptic packages, or packages that must be kept refrigerated. Therefore, the foregoing and following description is to be viewed as illustrative and not in a limiting sense. BRIEF DESCRIPTION OF THE DRAWINGS FIG. 1 is a schematic view of an aseptic package forming, filling, sealing, and bricking machine including the seam and tab folding and tacking apparatus in accordance with the present invention.

Figures 12A, 12B, 12C, 12D, 12E, 12F:
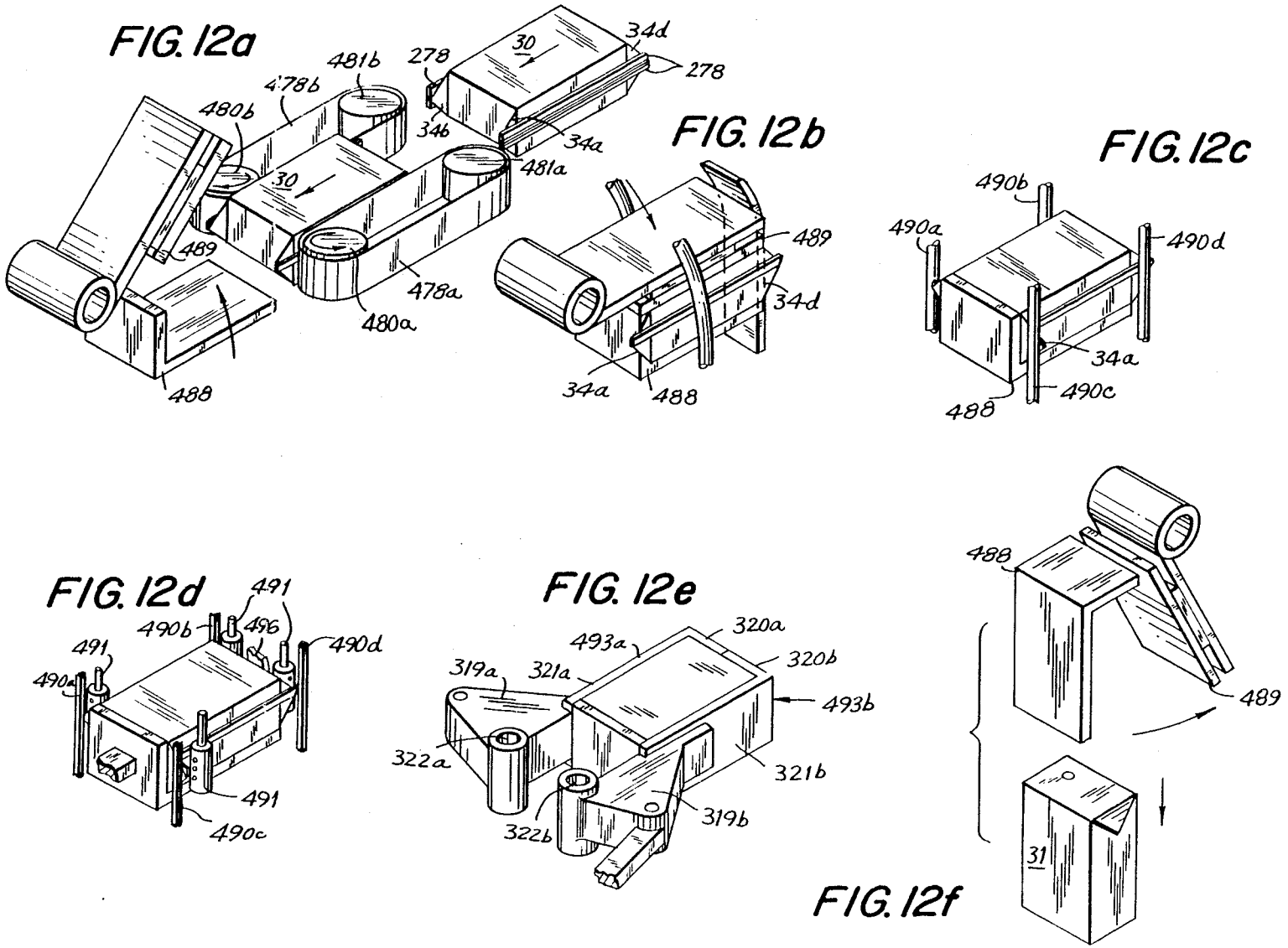
Figure 13:
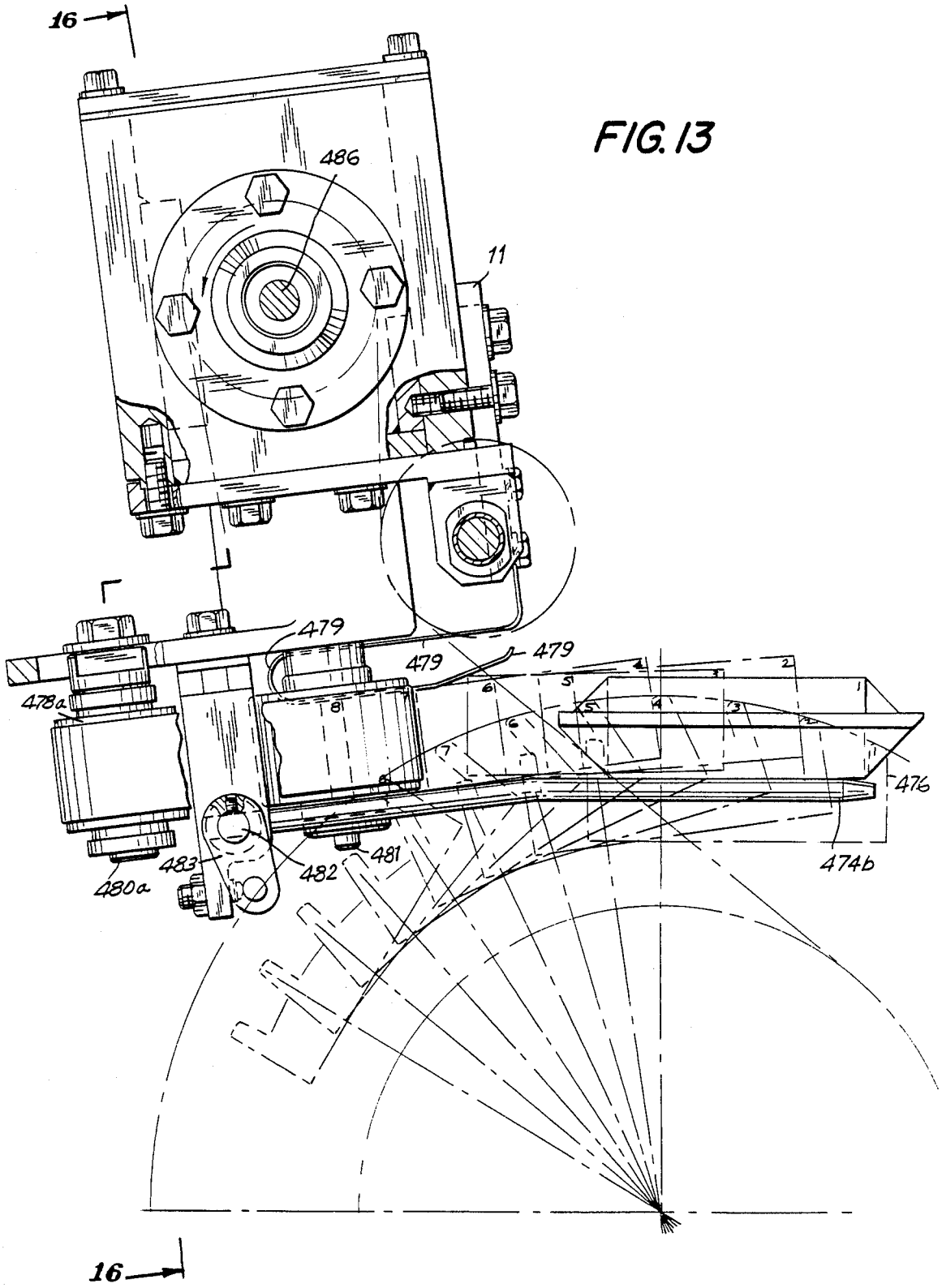

FIGS. 12*a*—12*f* are a series of schematic diagrams of the tab folding and tacking operation in accordance with the present invention FIG. 13 is a side view of the package take-off portion of the transfer conveyor assembly in accordance with the present invention.

Figure 8:
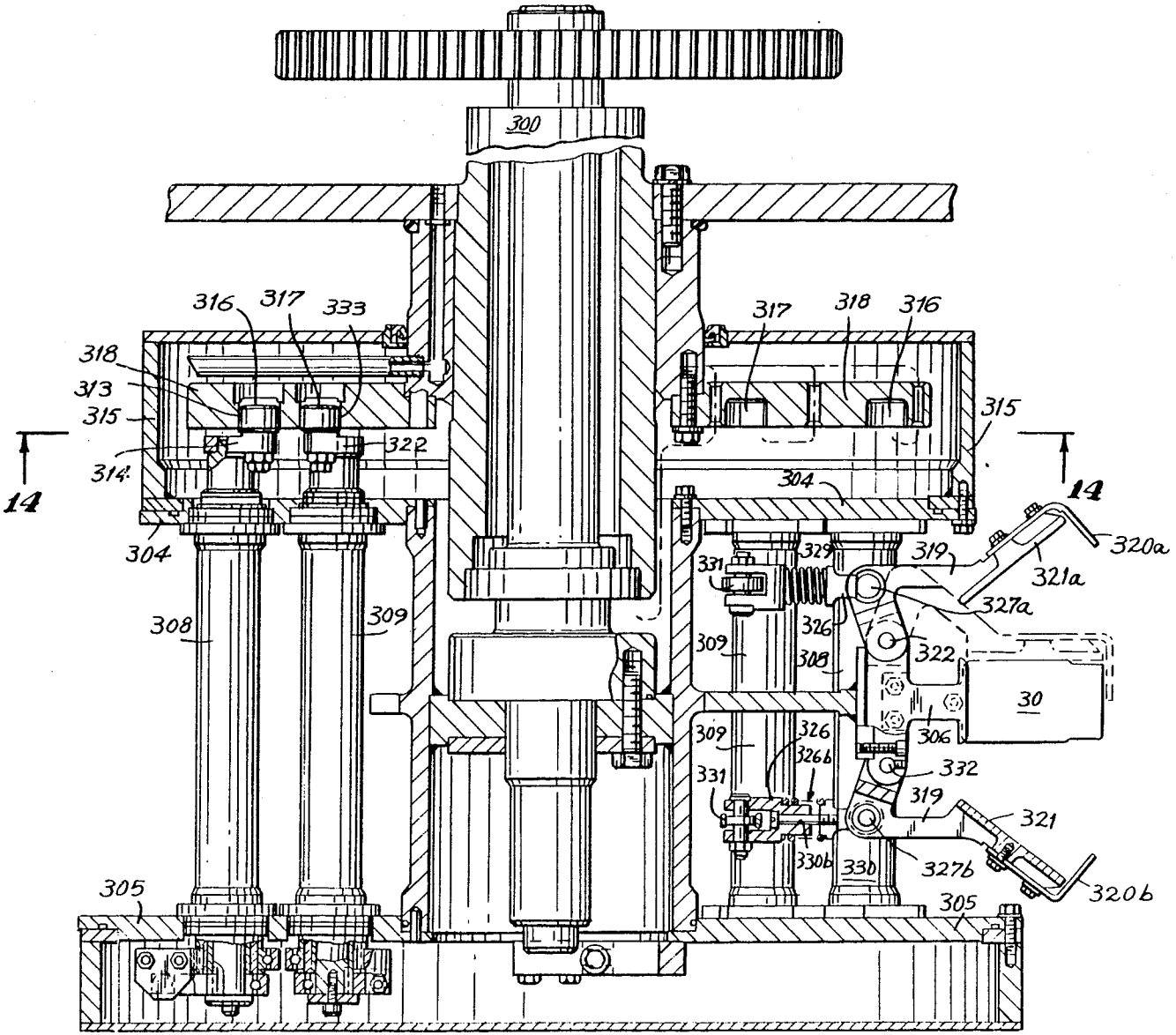
FIG. 8 is a top cross sectional view of FIG. 7 taken along line 8—8.
Figure 9:
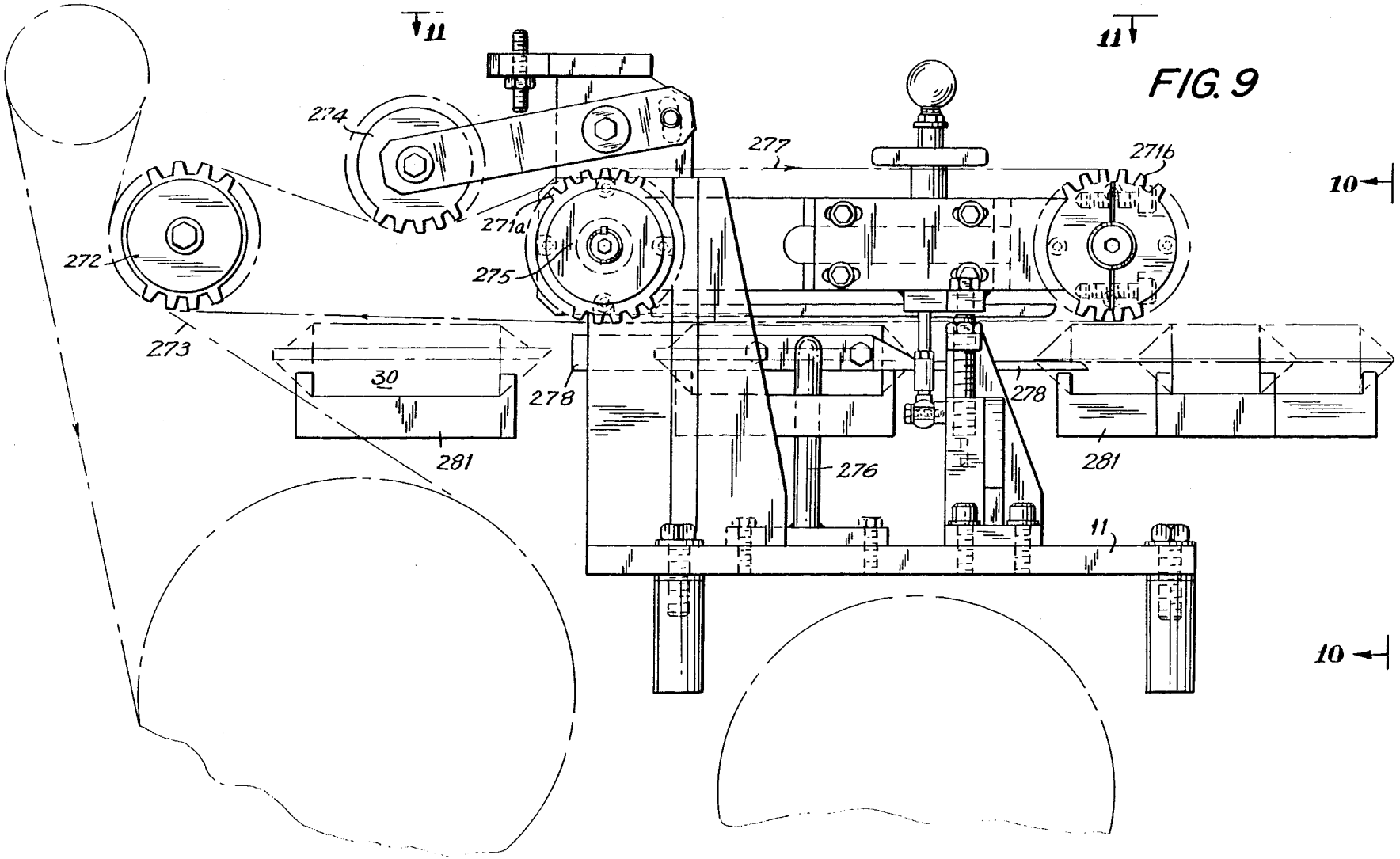
FIG. 9 is a side view of the package squaring operation of the transfer conveyor assembly in accordance with the present invention.
Figure 10:
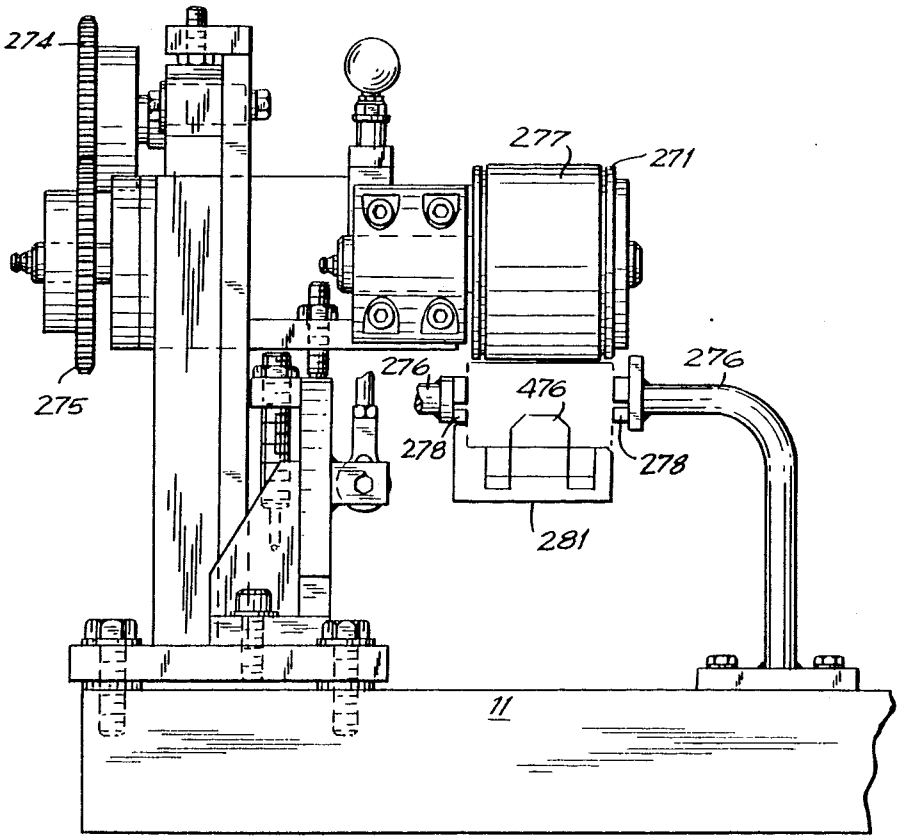
FIG. 10 is an end view of FIG. 9 taken along line 10—10.
Figure 11:
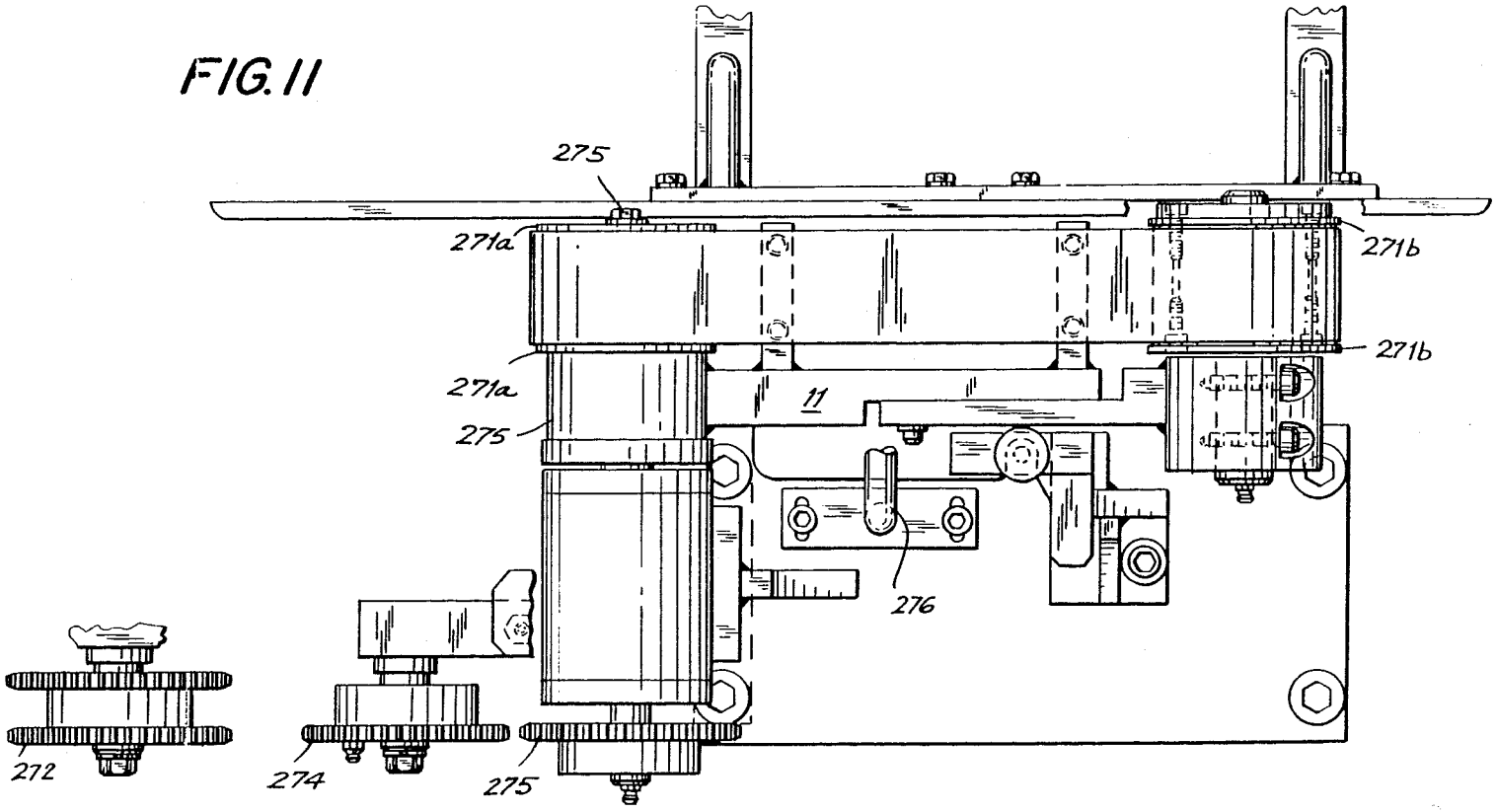
FIG. 11 is a top view of FIG. 9 taken along line 11—11.
Figure 14:
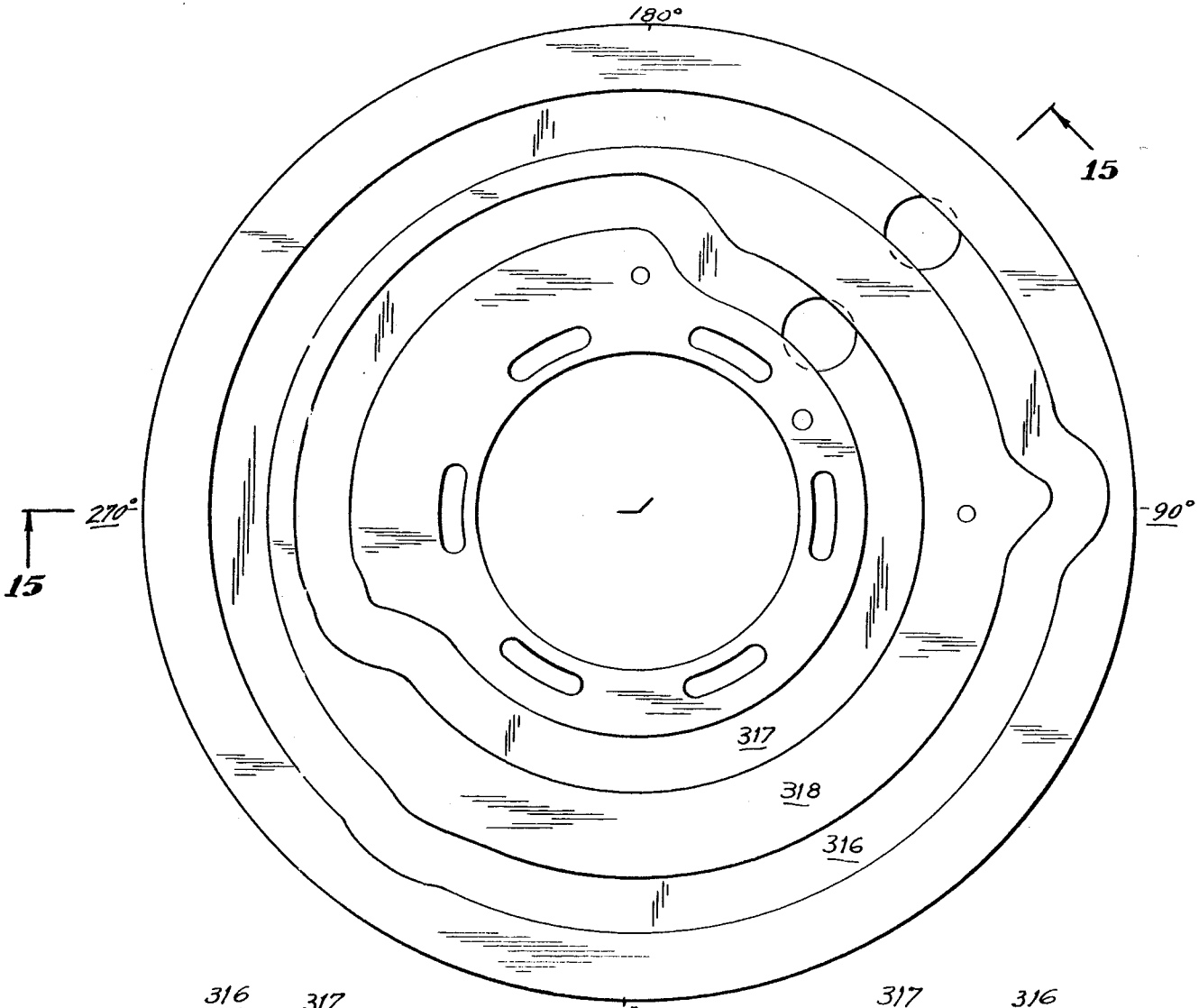

FIG. 14 is a cross sectional view of FIG. 8 taken along line 14—14.

Figure 15:
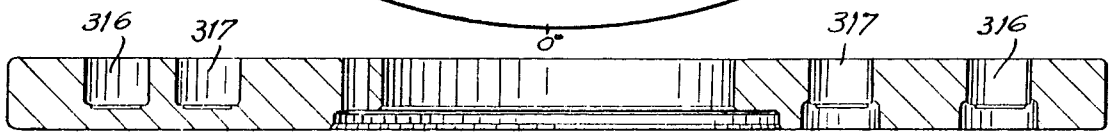

FIG. 15 is a cross sectional view of FIG. 14 taken along line 15—15.

Figure 16:
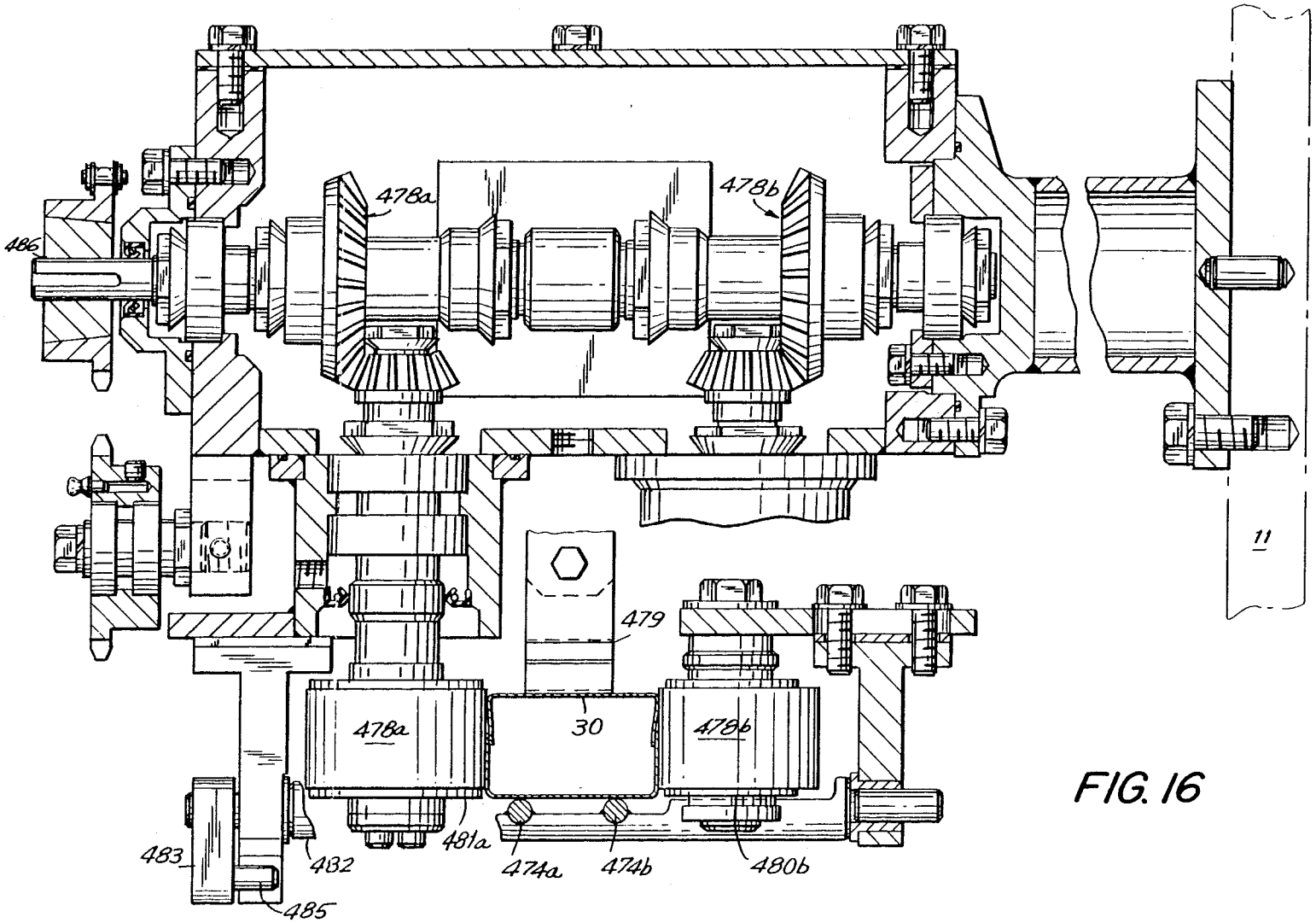

FIG. 16 is a front cross sectional view of FIG. 13 taken along line 16—16.

Figure 17:
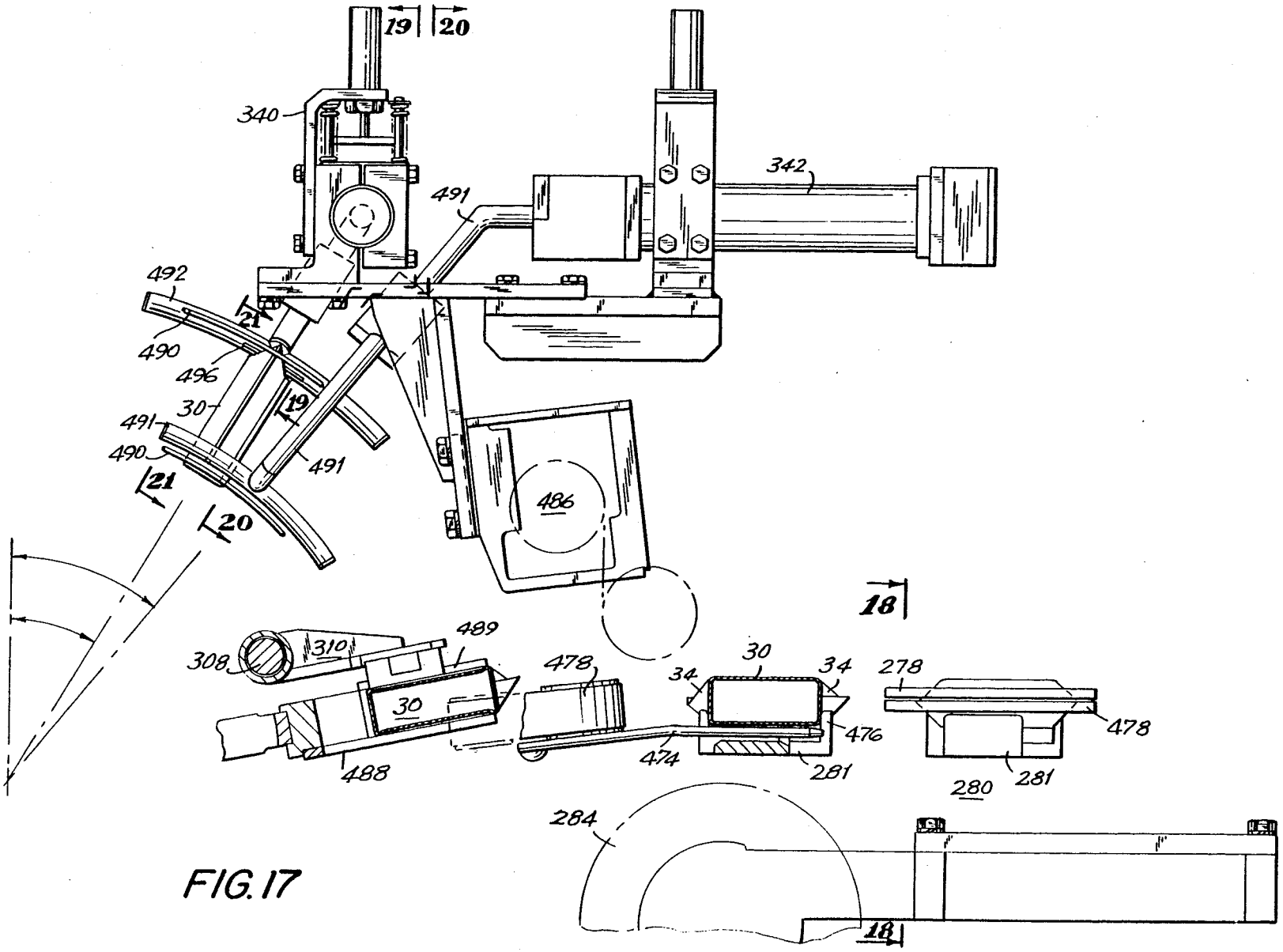

FIG. 17 is a schematic view of the seam folding and tab folding and tacking operations in accordance with this invention.

Figure 18:
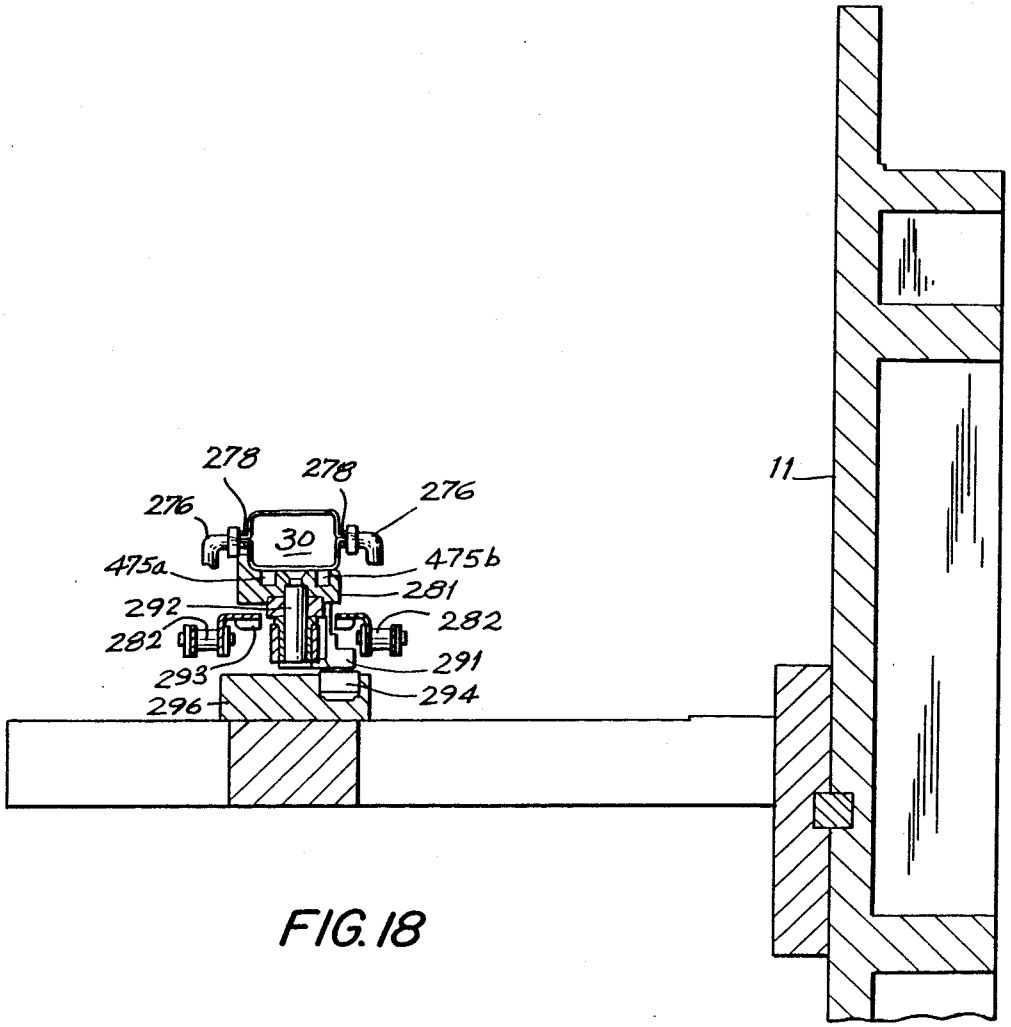

FIG. 18 is a rear sectional view of FIG. 17 taken along line 18—18.

Figure 19:
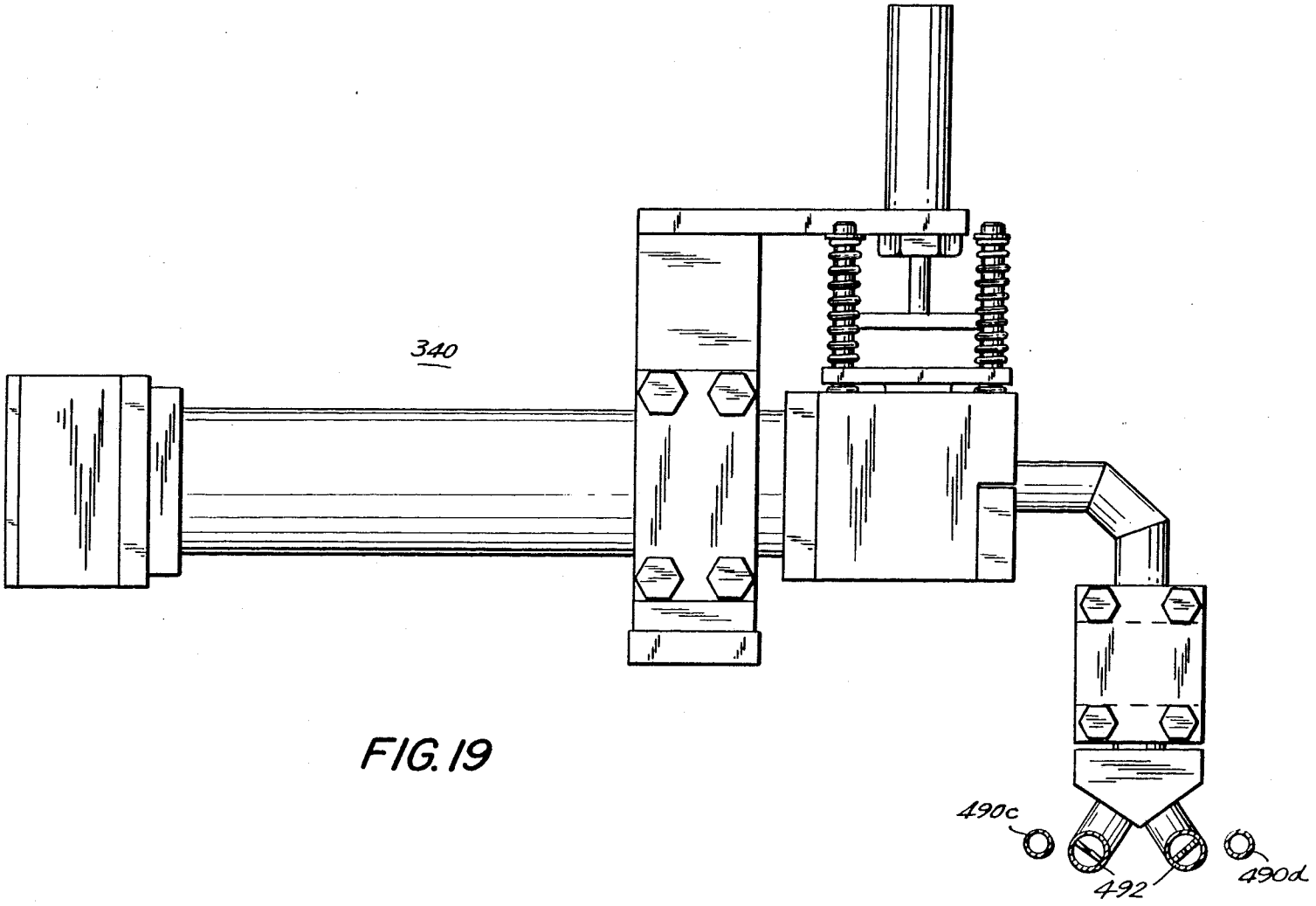

FIG. 19 is a front sectional view of FIG. 17 taken along line 19—19.

Figure 20:
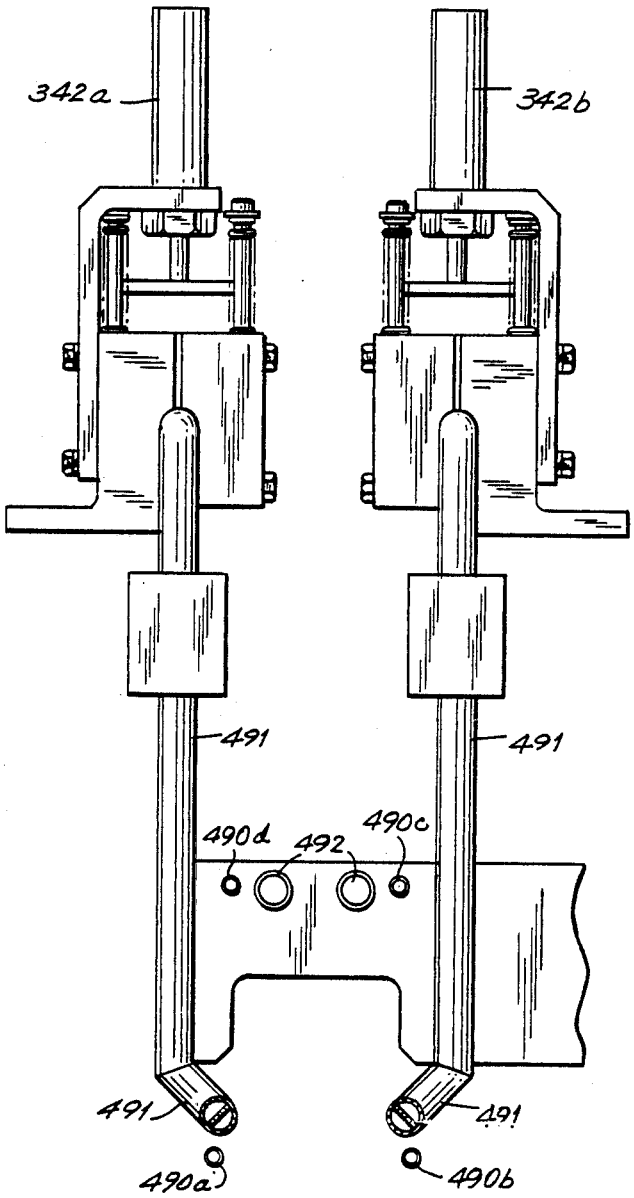

FIG. 20 is a rear sectional view of FIG. 17 taken along line 20—20.

Figure 21:
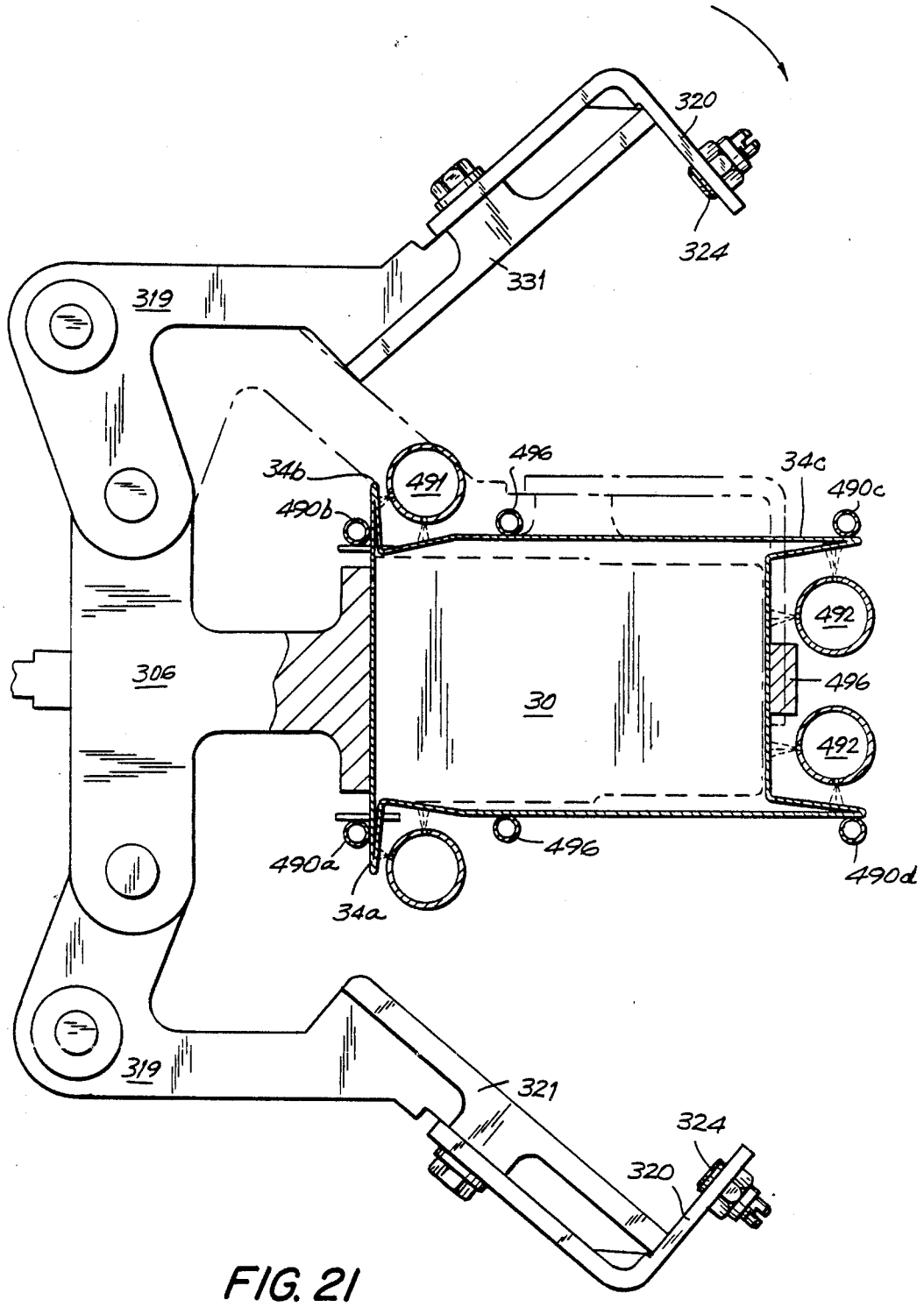

FIG. 21 is a rear sectional view of FIG. 17 taken along line 21—21.

Figure 22:
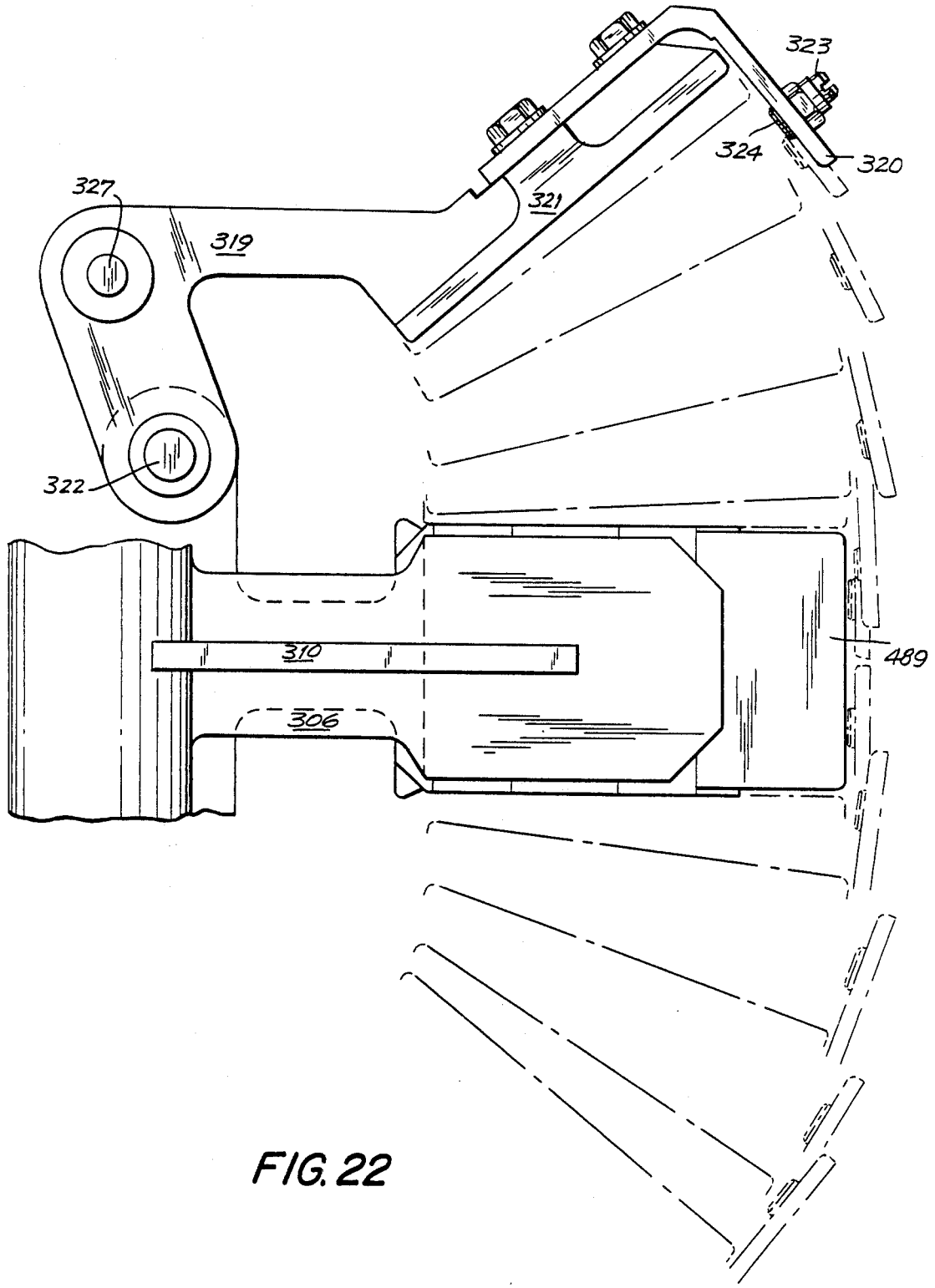

FIG. 22 is a schematic view of the tab folding and tacking apparatus of FIG. 21.

Figure 23:
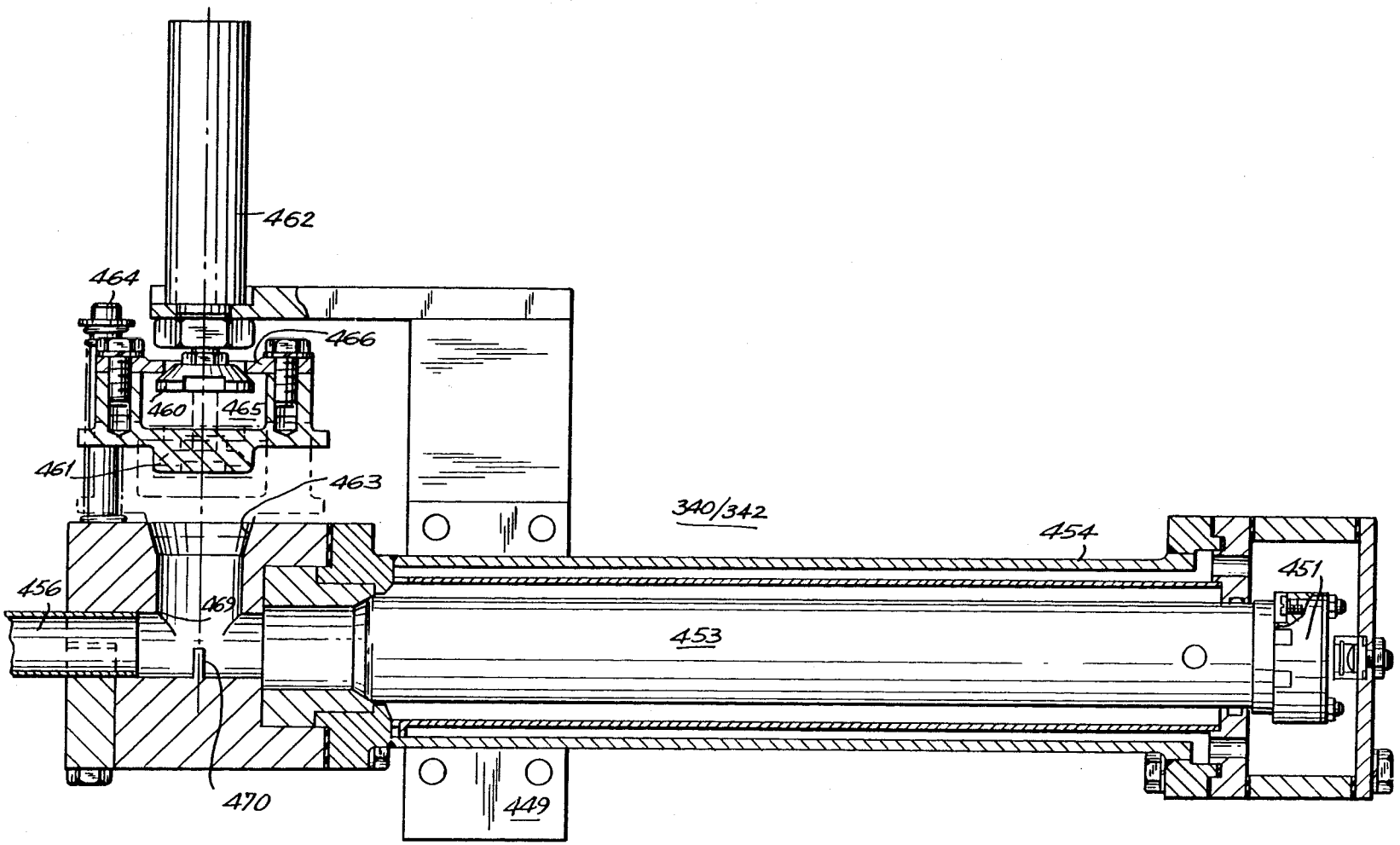

FIG. 23 is a front cross sectional view of FIG. 17 taken along line 23—23.

Figure 1:
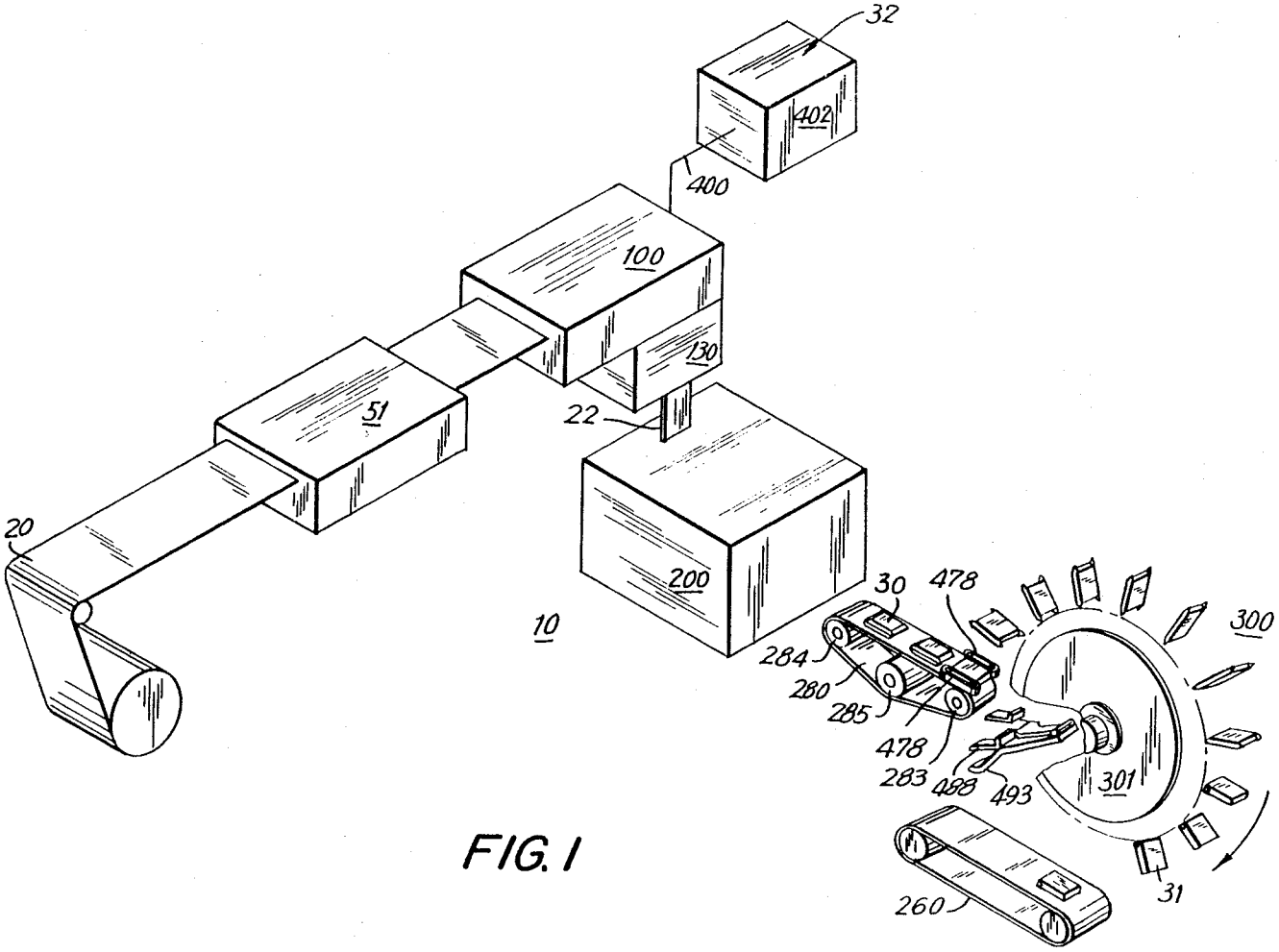
Figure 24:
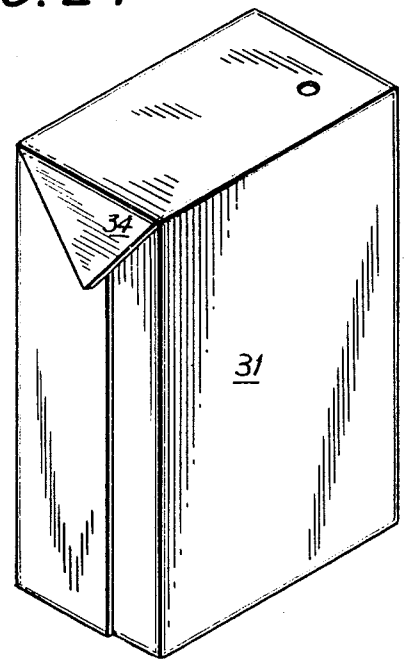

FIG. 24 is a package formed by the machine shown in FIG. 1 in accordance with the present invention.

DETAILED DESCRIPTION OF THE INVENTION

As shown in FIG. 1, an illustrative embodiment of this invention is useful in connection with form, fill, seal, and brick machine 10, which may be a microprocessor controlled apparatus that produces finished polyfoil packages 31 filled with product 32 by passing polyfoil web 20 into machine 10 through scoring area 51, passing scored web 20 into area 100 which is cleaned and preferably presterilized, to sterilize web 20, forming web 20 into polyfoil tube 22 by sealing web edges together in vertical seal area 130, filling tube 22 with product 32 through filler tube 400 without introducing ambient, unsterile, and preferably any air into the product filled tube, passing filled tube 22 into cross seal apparatus 200 to transversely clamp, seal, sever, and brick tube 22 into discrete preformed packages 30 which are then formed into finished containers 31 by folding the seams flat against the panels of package 30 as package 30 advances across transfer conveyor 280 between pressing members 278 an belt 277 and conveyer 280, and then inserting package 30 into tab folding wheel 300 where the tabs are heated, folded, and held against the packaging panels to form the finished brick 31. Brick forming apparatus 300 and package forming wheel 301 then advance the finished package 31 for subsequent handling, e.g., for straw application, bundling, and shipping. The apparatus may be driven intermittently or, preferably, continuously in a controlled fashion under microprocessor control as known to those of skill in the art.

Figures 2, 3:
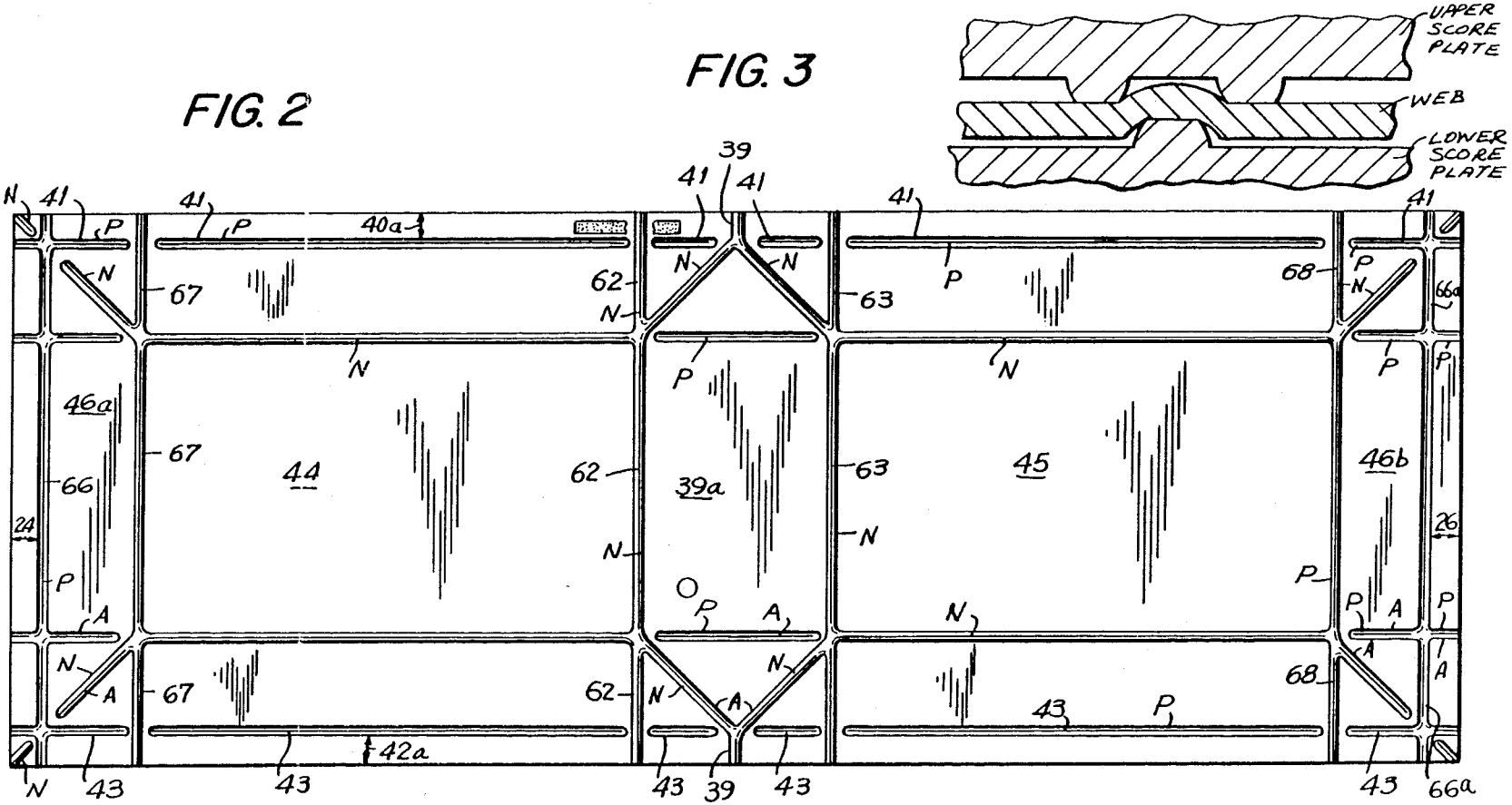
FIG. 2 is a top sectional view of a polyfoil web corresponding to one package, after scoring, for use in accordance with the present invention.
FIG. 3 is a cross-sectional view of a conventional scoring unit for the web of FIG. 2.
Figure 4:
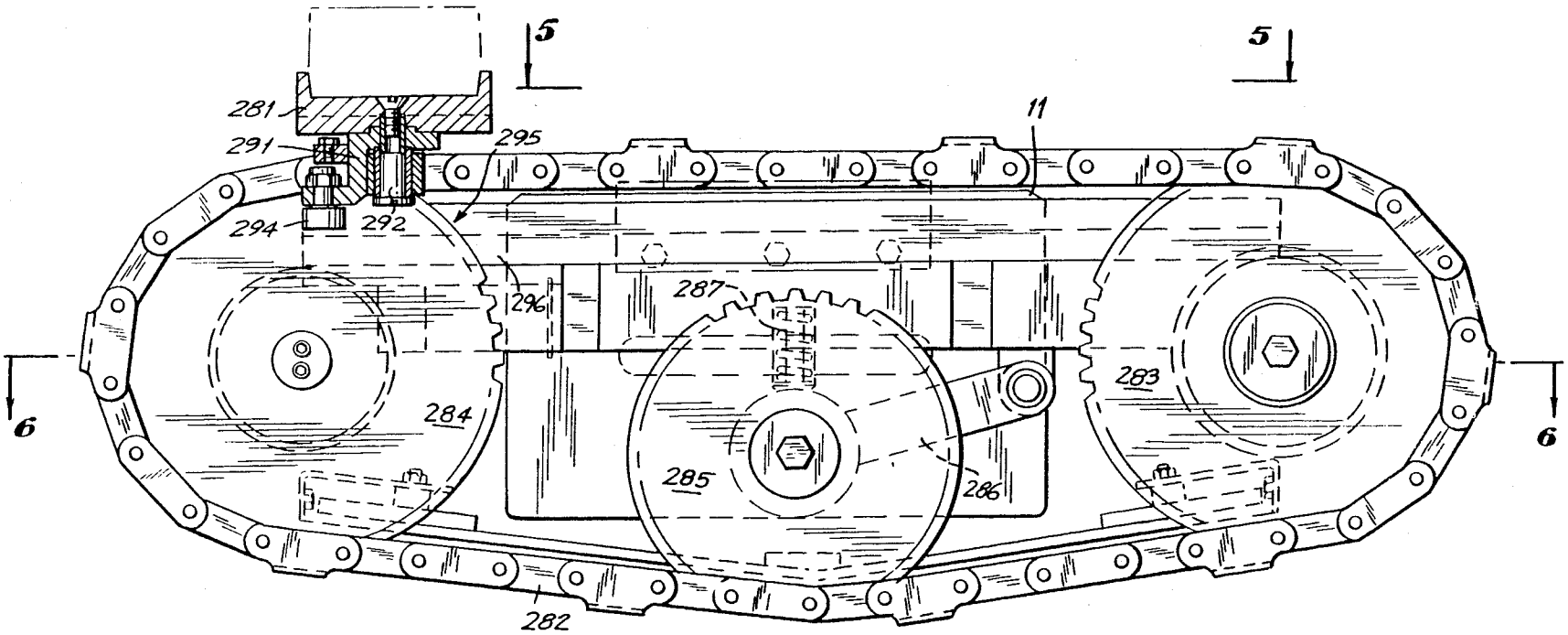
FIG. 4 is a side view of the transfer conveyor assembly in accordance with present invention.
Figure 5:
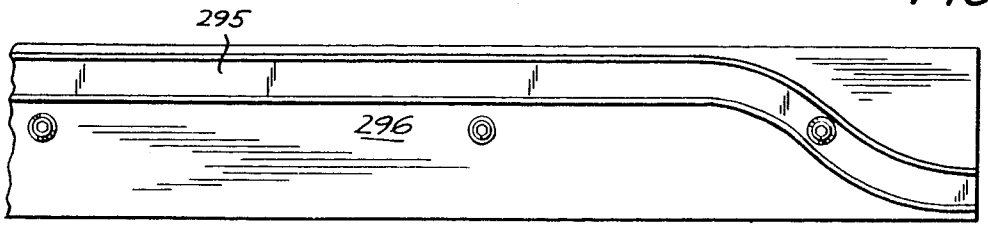
FIG. 5 is a top partial view of FIG. 4 taken along line 5—5.
Figure 6:
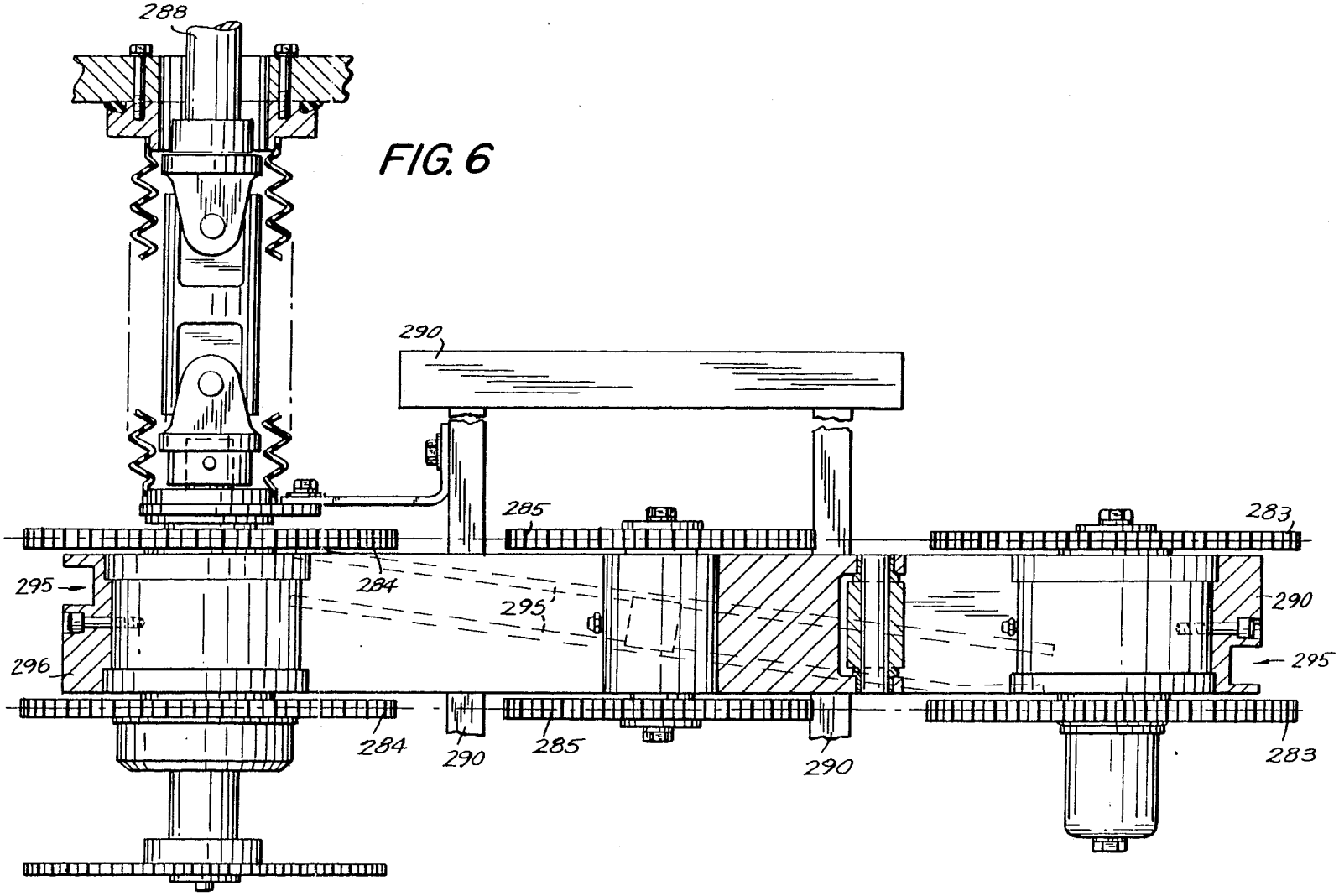
FIG. 6 is a top sectional view of FIG. 4 taken along line 6—6.
Figure 7:
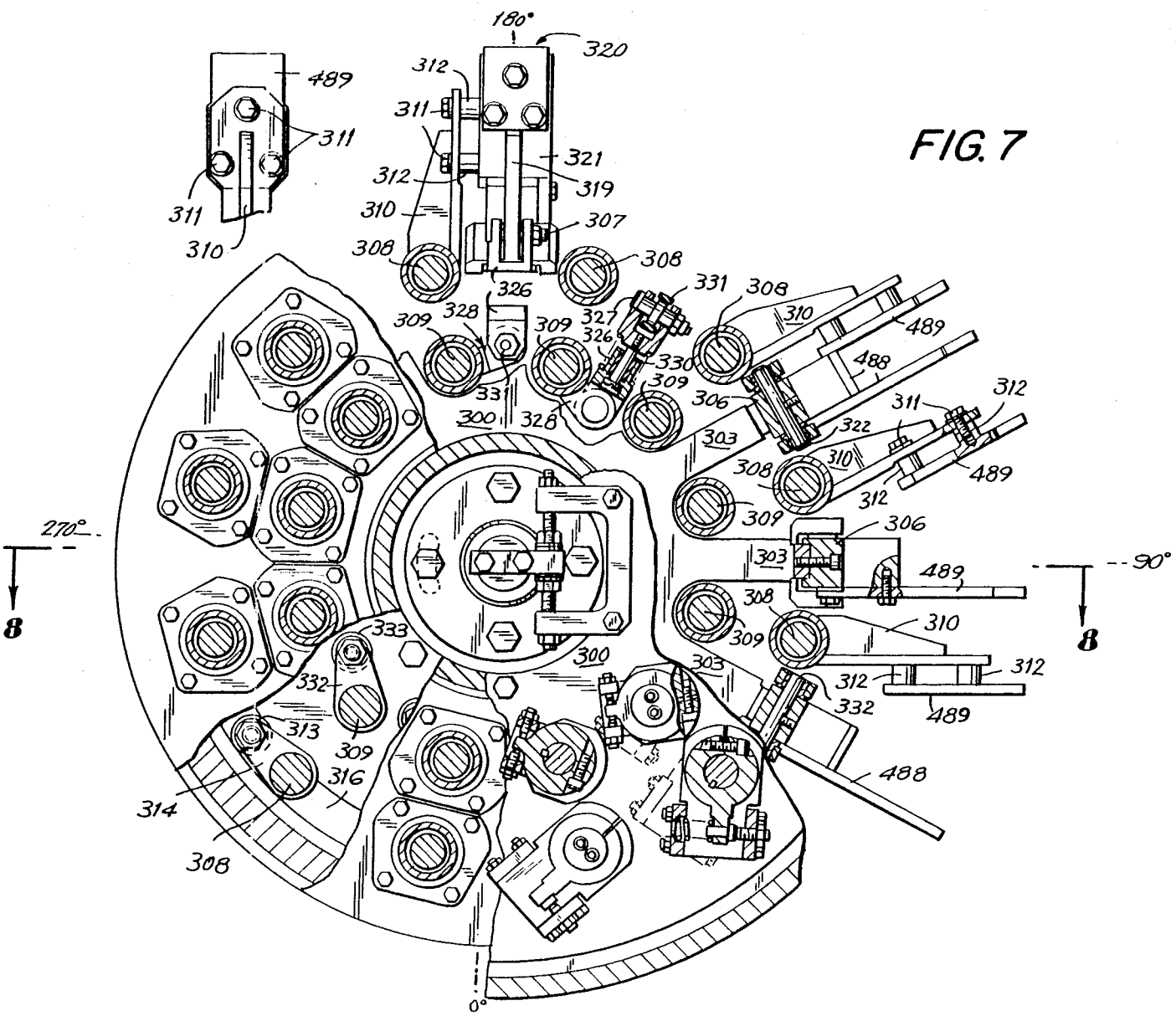
FIG. 7 is a side cutaway view of the tab folding and sealing assembly in accordance with the present invention.

As shown in FIGS. 2 and 3, scoring unit 51 imprints a pattern of positive and negative and vertical, horizontal and 45° score lines into web 20 to facilitate package forming and brick molding into final form, e.g., rectangular package 31 (see FIG. 24). In the preferred embodiment, positive score lines P an negative scorelines N (or male and female, respectively), relative to the foil side view, are arranged to facilitate proper and uniform folding and squaring of web 20 into package 30 and finished package 31. The score line arrangement permits forming polyfoil package 30 into a substantially rectangular finished package 31 having a substantially flat bottom without unduly stretching, tearing or delaminating web 20, particularly at the web corners. This permits bundling and stacking of finished packages and prevents product leakage.

The web may be scored conventionally, e.g., using coacting scoring rollers as it is taken off the supply or before being rolled into a supply of web. For aseptic packaging the cleaned and sterile web is maintained in a sterile environment at least until after the product containing package is transversely sealed completely. A supply of sterile air is used from which sterile air flows to the inside of tube 22 to maintain aseptic sterility of the product filled tube and the product in the tube before the tube is sealed transversely. Preferably, longitudinal sealing is by induction heating, fusing hermetically the inside thermoplastic layers of opposing web edges together; but alternative sealing means could be used, e.g., heat, sonic, dielectric or thermal welding or the like. Alternate constructions of tube 22 could include sealing the web edges inside to outside in an overlapping fashion, sealing together multiple pieces of web or using spirally wound web to form the tube. The advancing tube 22 is transversely clamped sequentially to fix substantially the same volume of product and amount of web in each package, and the tube is then sealed in the area where it is clamped, preferably by r.f. induction heating, and then severed in the sealed area to form packages 30.

Referring to FIGS. 1, 4–7, 9–11, 12(a–f) and 17, the package squaring, seam folding, and tab folding and tacking apparatus 300, also referred to as brick forming apparatus 300, of the present invention are shown, including transfer conveyor 280 and package forming wheel 301. Transfer conveyor 280 of the present invention is shown to receive transversely sealed discrete packages 30 filled with product 32 from the output of cross seal apparatus 200, preferably after the packages have been preformed by compressing filled package 30 on all sides so that the polyfoil material foils about its score lines. The transverse sealing mechanism holding package 30, typically one of a plurality of such mechanisms on a continuously advancing wheel, brings package 30 in proximity to pallet 281, whereupon the means retaining package 30 to the sealing mechanism, e.g., a pair of wire forms or guide rails, a vacuum activated suction cup, or a clamping arm, is actuated to release package 30 and place it onto corresponding pallet 281. Pallet 281 is adapted preferably to receive the leading transversely sealed edge of package 30. Endless chains or belt 282 of conveyor 280 may be supplied with a plurality of pallets 281 and advanced continuously at a rate of speed sufficient to receive each package 30 from cross seal apparatus 200 as it reaches transfer conveyor 280 and advance each package towards package forming wheel 301 of brick forming apparatus 300. Transfer conveyor 280 also may rotate packages 30 about their center when necessary so that the leading and trailing transverse seals become disposed on the sides of transfer conveyor 280, and the top panel of the package becomes the leading edge. This arrangement facilitates package squaring, bricking, and tab tacking of package 30 to form finished brick 31 as discussed below. Other orientations could be used as will become apparent.

In the preferred embodiment, transfer conveyor 280 comprises two endless chain link belts 282 respectively connected to parallel sprocketed guide wheels 283 and parallel powered sprocketed guide wheels 284. Parallel dancer sprocketed wheels 285 are pivotally mounted to frame 290 on movable arm 286 and urged against belts 282 by spring 287 to provide tension to take up any slack and keep belts 282 on the sprockets as they advance. Wheels 283, 284, and 285 are maintained so that the peripheries of parallel wheels rotate at the same speed. Powered wheels 284 are driven by drive shaft 288 from a drive source (not shown) for machine 10.

In the preferred embodiment, each pallet 281 is pivotably mounted on pivot post 292 in platform 293 which is connected to both chains or belts 282. pallet 281 has secured to it lever arm 291 at the end of which is cam follower 294 for controlling the orientation of pallet 281 relative to transfer conveyor 280. Cam follower 294 is adapted to run in cam groove 295 which is cut in cam 296. Cam 296 is fixed, relative to advancing belts 282 an disposed below pallet 281 and platform 293. Cam groove 295 and is designed to move cam follower 294 and lever arm 291 transversely across the path of advancement as pallet 281 advances so as to rotate pallet 281 ninety degrees about pivot post 292 (see FIG. 5). Cam 296 may extend all the way about the axis of guide wheels 283 and 284 so as to continuously guide cam follower 294 and orient pallet 281 accordingly, including the return of cam follower 294 to its package receiving orientation. Alternately, cam 296 may extend only along the path of the pallets from package reception to package delivery with twin guide wires 295 (FIG. 6) controlling the pallet return or with a cam follower catch means such as a funnel (not shown) provided for returning pallet 281 to its package receiving orientation.

Referring to FIGS. 7–23, brick forming apparatus 300 including side seam folding and package forming means and package forming wheel 301 are shown.

In the preferred embodiment, package 30 is advanced between side pressing members 278 mounted on support members 276 disposed on opposite sides of conveyor 280. Disposed above pressing members 278 is endlessly advancing belt 277 passing over pulleys 271*a* and 271*b* and driven by drum 275 from the machine drive means (not shown) via chain or belt 273 and pulleys 272 and 274. Conveyor 280 and belt 277 cooperate to advance package 30 between pressing members 278 which contact and gradually fold the side seams over as package 30 advances. Conveyor 280 and belt 177 also maintain package 30 in a rectangular cross section (see FIGS. 10 and 18).

To accommodate the seam folding, side pressing members each may be comprised of two forms or plows spaced apart a distance sufficient to accommodate a side seam therebetween, or a single block of material having a groove cut out to receive and fold the seam. In the preferred embodiment, the presser members present a single flat surface which forces the seam to fold as the package is advanced. In an alternate embodiment, means may be provided for heating the side seams and adjacent package panels immediately before folding so as to tack the side seams in addition to folding them.

Brick forming apparatus 300 receives package 30 after its side seam flaps have been folded and optionally, tacked. Rails 474*a* and 474*b* enter grooves 475*a* and 475*b* in the base of pallet 281 underneath package 30. Rails 474*a* and 474*b* are maintained in a fixed orientation relative to frame 11. As conveyor 280 continues to advance, the leading edge of package 30 begins to ride on rails 474*a* and 474*b* so that the leading edge of the package separates from pallet 281 as pallet 281 begins to follow the curvature of belts 282 around sprocketed wheel 284 to return to the front of transfer conveyor 280 to receive another package. Thus, rails 474 lift package 30 off pallet 281 while rear lip 476 of pallet 281 continues to push package 30 forward along rails 474.

Coacting drive belts 478*a* and 478*b* are arranged in opposition above and straddling rails 474*a* and 474*b* spaced apart about a distance less than the width of a finished formed and bricked package. Belts 478*a* and 478*b* rotate about drums 480*a* and 480*b*, and driven drums 481*a* and 481*b*. When pallet 281 advances, it drives package 30 into frictional contact with advancing belts 478*a* and 478*b* which grab package 30 by its side panels and propel package 30 along guide rails 474*a* and 474*b* away from pallet 281, between the belts an underneath pressure plate 479 to insert package 30 into brick forming apparatus 300. Pressure plate 479 in cooperation with rails 474 prevents package 30 from distorting or bulging as it is advanced by belts 478 and maintains package 30 oriented properly for insertion into package forming wheel 301. The force exerted on package 30 by belts 478*a* and 478*b* presses the side seams against the side panels of package 30, but is not so great as to distort the substantially rectangular package configuration which, if excessive, could rupture the seals.

Rails 474*a* and 474*b* are mounted in arm 482 which is pivotally connected at both ends to frame 11 of the belt drive mechanism. At one end, arm 482 extends beyond frame 11 and comprises means for adjusting the orientation of arm 482, and thus the orientation of rails 474*a* and 474*b*, for example by ever 483 secured to arm 482 having pin 485 adapted to contact set screw 484. Adjusting set screw 484 thus rotates arm 482 and changes the position of rails 474*a* and 474*b* to obtain proper location for package transfer.

Coacting belts 478*a* and 478*b* are driven from shaft 486 through opposing bevel gear transmissions 487*a* and 487*b* connected to drums 481*a* and 481*b*, respectively, to have opposite rotations for uniform advancement of packages. Drums 480*a* and 480*b* are rotatably mounted in frame 11 of machine 10 to keep belts 478*a* and 478*b* sufficiently taut to advance the package without slipping relative to drums 480 and 481.

Referring to FIGS. 12(a–f), the functions of package forming wheel 301 are shown schematically. Package 30 is loaded top end first into a receptacle comprising L-shaped flange 488 and flat plate 489 (FIG. 12*a*) and urged flush against flange 488. Plate 489 closes and clamps package 30 after package 30 exits belts 478*a* and 478*b* to maintain proper package alignment with forming apparatus 300 (FIG. 12*b*). Guide rails 490(a-d) act on triangular tabs 34(a-d) respectively when package 30 is inserted into package forming apparatus 300, to urge gradually tabs 34*a* and 34*b* into position for being heated and maintaining the heating position of tabs 34*c* and 34*d* (FIG. 12*c*). Additional guide rails 496 are added on bottom and at the sides of package 30 to keep package 30 seated in L-shaped flange 488 in the proper orientation so that guide rails 490(a-d), acting on tabs 34(a-d), do not cause package 30 to rotate or shift. Heater means 491 and 492, e.g., elongated nozzles, blow hot air on triangular tabs 34(a-d) and on the corresponding sides and bottom of package 30 to heat and soften the outer layer of thermoplastic material (FIG. 12*d*) before tabs 34 are pressed against their corresponding side panels, bottom panel, or other package panels. Tab folders 493*a* and 493*b* press heated triangular tabs 34(a-d) against heated package 30 and square off package 30 into finished brick 31. Guide rails 490(a-d) extend a distance beyond the tab heating area to hold the tabs in a folded condition until tab folders 493*a* and 493*b* can be brought into play. Guides 490 may be provided with a thin cross section to maximize the tab holding time. Tab folders 493*a* and 493*b* retain tabs 34 in their folded positions-for the time required to allow tabs 34 to fuse, cool, and stick to their corresponding package panels (FIG. 12*e*). Afterwards, tab folders 493*a* and 493*b* are retracted and finished package 31 is released in its finished form for subsequent handling (FIGS. 12*f*, 17, 24). Each of these events occur as packaged forming wheel 301 rotates continuously so that in the preferred embodiment, package travel is through about 232° from insertion to ejection from wheel 301. Thus, the quantity of packages to be processed per hour, designed to accommodate more than 10,000 packages per hour, can be adjusted by controlling the temperature and time operating conditions for heating and holding heated web for tacking, the velocity of the heated air, and the speed of rotation of brick forming wheel 301.

Referring to FIGS. 7, 8, 14, and 22, brick forming wheel 301, shown in detail, comprises a plurality of substantially identical bricking devices for carrying out the tab folding and bricking procedures described above and illustrated in FIGS. 12(a-f). In the preferred embodiment, 12 devices are mounted about the periphery of wheel 301 and travel with the package on which it operates. Wheel 301 comprises cylinder 302, plurality of spokes 303 preferably extending radially at a right angle to the axis of cylinder 302, and side flanges 304 and 305 perpendicular to the respective ends of cylinder 302.

Each bricking device has L-shape flange 488 mounted on bracket 306 which is in turn mounted at the end of spoke 303. Flange 488 is thus oriented so that the larger dimensioned surface of L-shape flange 488 is adapted to receive and contact the broad side, i.e., one of the front panel 44 or back panel 45 of package 30, as it is inserted into brick forming wheel 301. In the preferred embodiment flange 488 is oriented so that the short end is in a plane orthogonal to a radial line extending from the center of cylinder 302 along the midline of spoke 303 and the long section is parallel to and spaced apart from that radial line by a distance equal to about one-half package thickness. In the preferred embodiment, package 30 is inserted into flange 488 while the large end is about horizontal and moving upwardly.

Shafts 308 and 309 are rotatably mounted in and between parallel flanges 304 and 305 extending at right angles from cylinder 302. The rotation of shafts 308 and 309 are controlled by a lever arm-cam shaft system described below.

Flat plate 489 is secured to arm 310 by bolts 311 and spacers 312. Arm 310 is secured to shaft 308 so that as shaft 308 rotates, arm 310 and flat plate 489 rotate through the same number of arc-degrees until flat plate 489 makes contact with flange 488. Shaft 308 may continue to rotate for about 2° more, setting the springs. The springs serve to allow the form to close completely and still have a nonrigid connection with the cam follower. The springs also allow the form to open somewhat in case of a jammed package and provides adequate play to prevent breaking the cam, cam follower or arm.

One end of shaft 308 extends beyond side flange 304 into housing 315. Lever arm 314 is secured to the end of shaft 308 so that it rotates with shaft 308. At the end of lever arm 314 is cam follower 313 mounted for rotation and adapted to follow cam groove 316 in cam 318. See FIGS. 14, 15. Cam 318 is mounted in housing 315 and does not rotate relative to machine 10. Cam groove 316 is designed to move cam follower 313 relative to the axis of rotation of shaft 308 at preselected locations and thereby rotate shaft 308 for causing flat plate 489 to rotate towards L-shaped member 488 to contact package 30, as illustrated at 103° of FIG. 14, to maintain the plate in the closed position as wheel 301 continues to rotate, and then rotate plate 489 open, away from flange 488, for releasing finished brick 31.

A plurality of paired tab folders 493*a* and 493*b* are mounted on wheel 301, each spoke 303 having a corresponding pair of tab folders 493*a* and 493*b*. In the following discussion, the "a" and "b" suffixes indicate the same structures arranged in opposition except as otherwise indicated. Each pair of tab folders 493*a* and 493*b* comprise respectively, support members 319*a* and 319*b*, opposing L-shaped forms having short legs 320*a* and 320*b* and long legs 321*a* and 321*b*. Tab folders 493*a* and 493*b* are mounted in opposition on respective pins 322*a* and 322*b* on opposite sides of bracket 306, oriented in parallel and perpendicular to the broad surface of L-shaped flange 488. Tab folders 493*a* and 493*b* are adapted to rotate about pins 322*a* and 322*b* towards and away from contact with package 30 t press heated triangular tabs 34*a* and 34*b* against their respective sides and tabs 34*c* and 34*d* against the bottom of package 30 until they stick and cool, forming brick 31. Adjustment screw 323 an screw contact pin head 324 are mounted in each of short legs 320*a* and 320*b* for pressing triangular tabs 34*c* and 34*d*, as indicated in FIG. 21, into the bottom of package 30 so that the bottom surface becomes somewhat concave, with triangular tabs 34*c* and 34*d* and the former longitudinal seal recessed within the plane formed by score lines 68 and 67 (see FIG. 2). This provides brick 31 with a bottom surface that will be stable and stand upright when placed on a relatively flat surface.

The motion of tab folders 493*a* and 493*b* is also controlled by a cam-lever mechanism. Pushrods 326*a* and 326*b* are pivotably connected at one end to support members 319*a* and 319*b* at pins 327*a* and 327*b* respectively. The other end of pushrods 326*a* and 326*b* are pivotably connected to arms 328*a* and 328*b* which are securely mounted to shaft 309 so that pushrods 326 are substantially parallel with respect to each other. In the preferred embodiment, pushrods 326 each comprise two rod sections connected together by compression spring 329 disposed about guide shaft 330. Spring 329 allows tab folders 493*a* and 493*b* to close completely and still have a nonrigid connection with the cam follower an allows the tab folders to open somewhat to prevent jamming. Pushrods 326 may also be connected to arms 328 by conventional self aligning bearings 331*a* an 331*b* to permit some angular movement of the pushrods about the bearings without binding as support members 319*a* and 319*b* are pivoted opened and closed about pins 322*a* and 322*b*.

The motion of shaft 309 and pushrods 326 are controlled by lever arm 332 securely connected at the end of shaft 309 in housing 315 and cam follower 333, rotatably mounted at the end of lever arm 332 and adapted to follow cam groove 317 of cam 318. Referring to FIG. 14, cam groove 317 is shown, defining the motion of cam follower 333 relative to a radius about the cam along which the axis of rotation of shaft 309 moves, causing rotation of shaft 309. That rotation is translated to the linear movement of pushrods 326*a* and 326*b* which cause tab folders 493 to rotate open and closed. In the preferred embodiment, referring to FIG. 14, tab folders 493 are closed at about 196°, and opened again at 323° after heated tabs 34 have had sufficient time to cool and fuse against the side walls and bottom of brick 31.

Referring to FIGS. 12(a-f), 17, 19, 20, and 21, the preferred tab folding and sealing operation is shown in detail. Package 30 is inserted into flange 488 and metal plate 489 which are rotating upwardly. Triangular tabs 34*a* and 34*b* (FIG. 21) of excess packaging material preferably extend at about a 90° angle from package side wall 36 and tabs 34*c* and 34*d* typically extend in parallel with the side seams-from the trailing edge or bottom of package 30. Guide rails 490 and 496 are located along the periphery of wheel 301 and the path each package 30 will travel so that package 30 will contact guide rails 496, which will keep package 30 seated properly and firmly, and guide rails 490, which gradually fold triangular tabs 34 to the desired orientation for heating, folding, and tacking, as package 30 is advanced.

Heater means 491 and 492 extend for a distance along the path of travel proximate to the corners of package 30 as shown in FIG. 17 and include hot air ducts 336 and 33B having a plurality of apertures (not shown) for permitting hot air to flow upon triangular tabs 34 ad sides 36 and 37 and bottom 38 of package 30 as package 30 moves along the length of ducts 336 and 338. The length of heater means 491 and 492 may be adjusted in relation to the temperature of the hot air as it exits the apertures, the hot air temperature being selected for a given exposure time to heat the outer thermoplastic layer of tabs 34 and package 30 to the temperature necessary for the thermoplastic layers to soften and stick together, given the spacing of heater means 491 and 492 from tabs 34 and package 30, the size of tabs 34, and the rate of travel of package 30. The velocity of the hot air also can be adjusted to control the heating time.

Hot air for heater means 491 and 492 are provided by hot air sources 340, 342*a* and 342*b* and 342. Source 340 provides hot air for heater means 492 through y-connector 341 as shown in FIG. 19, source 342*a* provides hot air for heater means 491*a*, and source 342*b* provides hot air for source 491*b*. Each hot air source is preferably substantially identical and is shown in FIGS. 17–20 and 23. Each hot air source comprises housing 454 having air intake 451 and heating element 453 mounted within housing 454, and bypass valve 455 comprising valve seat head 461, valve seat 463, T-section 469 and air cylinder 462. Air cylinder 462 may be operated under microprocessor control, manually under operator control, or some combination of both to raise or lower valve seat head 461 for releasing air out valve seat 463, for example, when machine 10 or transfer conveyor 280 is not operating and a stationary package would otherwise be continuously heated to too high a temperature under continued hot air flow.

Valve seat head 461 is slidably mounted on posts 464 for movement in a limited range up and down relative to valve seat 463. Compression springs 467 bias valve seat head 461 closed against valve seat 463 and exert a force of about 40 pounds. Air cylinder 462 opens head 461. Valve seat head 461 is adapted to seat smoothly with rod head 460 on the top side and with valve seat 463 on the bottom side. Valve seat head 461 is also adapted to retain rod head 460 within chamber 465 by means of cover plate 466 which prevents rod head 460 from moving a distance greater than the height of chamber 465 before moving valve seat head 461 for purposes of seating or unseating rod head 460 for closing off or opening the air passageway between valve seat 463 and the stem of T-section 469.

T-section 469 has deflector 470 extending from the cross member of T-section 469 to deflect air entering one side of the cross member towards the valve seat head 461. Deflector 470 aids in preventing air from passing out the heater means air jets when valve seat head 461 is open. The apertures in the air jets are configured to create a normal operating backflow pressure of about 5 psi. Deflector 470 is designed to operate and convert velocity pressure (air flow) to static to minimize air flow to the nozzle control. Hot air sources 340, 342*a*, and 342*b* are mounted on frame 11 of machine 10. Alternate sources of heat could be used, for example, other hot air heaters, radiant heat or induction heat.

Throughout brick forming apparatus, sensors may be provided, e.g., connected to the microprocessor for detecting the operation of the hot air sources and the temperatures of the air flowing over side seams and tabs 34 and the corresponding sections of package 30. When air flow is inadequate or temperatures too low to effect tacking, a signal may be generated and the machine stopped until the problem can be fixed. Hot air sources 340, 342*a* and 342*b* may be provided with adjustable temperature controls to raise or lower the heat generated by the heater element to compensate for the changes in ambient air temperature or humidity or different web stocks or seal areas and thereby control dynamically the application of heat required for tacking.

Referring to FIG. 1, discharge conveyor apparatus 260 receives finished packages 31 (FIG. 24) and delivers them to the appropriate station for subsequent packaging and shipping.

We claim:

1. A method of forming a substantially rectangular container from a sealed package having excess packaging material in a package forming machine having a transfer conveyor, including a pallet for receiving a package, a pair of side pressing members disposed on opposite sides of the conveyor for folding the seams, and a top pressing endlessly advancing belt disposed above the transfer conveyor, a package forming wheel rotatable about its axis including a plurality of package receiving receptacles having flanges and opposing tab folding members, the tab folding members having an open position and a closed position, a heater means disposed adjacent the wheel periphery, and guide rails disposed along the wheel periphery, the method comprising placing the package into a substantially rectangular cross section;

passing the package on the pallet, between opposing side pressing members, and under the top pressing belt;

folding the side seams against the corresponding package side panels by passing the seams against the respective side pressing members;

inserting the package into a package forming wheel receptacle as the wheel advances continuously about its axis;

pressing the package against the flanges of the package forming wheel receptacle by advancing the package against the plurality of guide rails; thereby squaring the corners of the package and forming tabs of excess material at each package corner;

heating the tabs and their corresponding package side and bottom panels as the package is rotated by the heater means; and folding and holding the heated tabs against the corresponding heated side panels by rotating the opposing tab folder members closed about the package so that the heated outer thermoplastic layers stick and adhere together as they cool, thereby tacking the tabs.

2. The method of claim 1 wherein the package forming machine also includes a heater means disposed adjacent the transfer conveyor and the method further comprises:

heating the side seams and the corresponding side panels by passing them by the heater means as the package is advanced along the transfer conveyor; and holding the folded and heated seams against their corresponding package side panels so that the outer thermoplastic layers stick and adhere together upon cooling, thereby tacking the side seams.

3. The method of claim 1 wherein squaring the package and folding the side seams provides well defined triangular tabs that extend parallel to the side seams substantially in an "H" like configuration before the tabs are folded.

4. The method of claim 1 further comprising orienting the pallet so that the top of the package will become the leading edge and the side seams become disposed on the sides of the conveyor.

* * * * *